US005647661A

United States Patent [19]

Gordin

[11] Patent Number: 5,647,661

[45] Date of Patent: Jul. 15, 1997

[54] HIGH EFFICIENCY, HIGHLY CONTROLLABLE LIGHTING APPARATUS AND METHOD

[75] Inventor: Myron K. Gordin, Oskaloosa, Iowa

[73] Assignee: Musco Corporation, Oskaloosa, Iowa

[21] Appl. No.: 375,650

[22] Filed: Jan. 20, 1995

Related U.S. Application Data

[63] Continuation-in-part of Ser. No. 820,486, Jan. 14, 1992, Pat. No. 5,402,327, Ser. No. 242,746, May 13, 1994, Pat. No. 5,595,440, and Ser. No. 242,745, May 13, 1994, Pat. No. 5,519,590.

[51] Int. Cl.[6] ..... F21V 7/00

[52] U.S. Cl. ..... 362/283; 362/153.1; 362/247; 362/256; 362/301; 362/323; 362/346

[58] Field of Search ..... 362/256, 153.1, 362/234, 237, 247, 282, 283, 298, 301, 322, 323, 346, 261

[56] References Cited

U.S. PATENT DOCUMENTS

| | | | |
|---|---|---|---|
| 860,451 | 7/1907 | Donnelly | 362/296 |
| 1,535,985 | 4/1925 | Clark | 362/341 |
| 1,814,326 | 7/1931 | Melton | 362/243 |
| 2,228,329 | 1/1941 | Reynolds | 362/284 |
| 2,280,640 | 4/1942 | Shockey | 240/103 |
| 2,390,109 | 12/1945 | Liebmann | 362/247 X |
| 2,520,445 | 8/1950 | Sponsler | 177/329 |
| 2,821,393 | 1/1958 | Hoppe | 272/10 |
| 3,065,336 | 11/1962 | Stevens | 240/9 |
| 3,511,983 | 5/1970 | Dorman . | |
| 3,586,851 | 6/1971 | Rudolph | 362/301 |
| 4,087,682 | 5/1978 | Kolodziej | 362/297 |
| 4,272,799 | 6/1981 | Downing | 362/145 |
| 4,344,120 | 8/1982 | Bradley et al. | 362/349 |
| 4,367,514 | 1/1983 | Large | 362/62 |
| 4,388,678 | 6/1983 | Turner | 362/293 |
| 4,408,266 | 10/1983 | Sclippa | 362/297 |
| 4,436,372 | 3/1984 | Schmidt et al. | 350/293 |
| 4,447,862 | 5/1984 | Shanks | 362/267 |
| 4,460,946 | 7/1984 | Tinz | 362/319 |
| 4,663,698 | 5/1987 | Tomlinson | 362/284 X |
| 4,712,167 | 12/1987 | Gordin et al. | 362/67 X |
| 4,809,147 | 2/1989 | Negishi | 362/347 |
| 4,890,208 | 12/1989 | Izenour | 362/301 |
| 5,067,062 | 11/1991 | Rulke | 362/364 |
| 5,117,343 | 5/1992 | Kerscher et al. | 362/297 |
| 5,134,550 | 7/1992 | Young | 362/298 |

FOREIGN PATENT DOCUMENTS

| | | |
|---|---|---|
| 1399448 | 4/1965 | France . |
| 562370 | 10/1932 | Germany . |
| 3447136 | 6/1986 | Germany . |
| 3446917 | 7/1986 | Germany . |
| 3534285 | 2/1987 | Germany . |
| 3711568 | 10/1988 | Germany . |
| 3820926 | 12/1989 | Germany . |
| 459308 | 5/1951 | Italy . |
| 415840 | 12/1960 | Switzerland . |
| 373814 | 1/1994 | Switzerland . |
| 193515 | 2/1923 | United Kingdom . |
| 536563 | 4/1946 | United Kingdom . |
| 862073 | 3/1961 | United Kingdom . |
| 2048166 | 3/1980 | United Kingdom . |
| WO94/15143 | 7/1994 | WIPO . |

OTHER PUBLICATIONS

Christian Bartenbach, Werner Kipper, Karl–Heinz Kratz; "Glare–Free Lighting for Airport Apron Areas An Aid to Exact Parkin" (Pre–publication of Design & Light Feb. 1991) (8 pages).

*Primary Examiner*—Stephen F. Husar

*Attorney, Agent, or Firm*—Zarley, McKee, Thomte, Voorhees, & Sease

[57] ABSTRACT

An apparatus and method of lighting which produces light of highly controlled nature and which makes sufficient use of the light including a light source, a primary reflector placed directly at or near the light source and a secondary reflector which receives light from light source and from the primary reflector and directs it to a target area.

47 Claims, 13 Drawing Sheets

HIGH EFFICIENCY, HIGHLY CONTROLLABLE LIGHTING APPARATUS AND METHOD

CROSS-REFERENCE TO RELATED APPLICATIONS

This is a continuation-in-part from commonly owned, U.S. Ser. No. 07/820,486 filed Jan. 14, 1992, now U.S. Pat. No. 5,402,327, U.S. Ser. No. 08/242,746 filed May 13, 1994, now U.S. Pat. No. 5,595,440 and U.S. Pat. Ser. No. 08,242,745 filed May 13, 1994, now U.S. Pat. No. 5,519,590.

INCORPORATION BY REFERENCE

The entire contents, including specifications and drawings, of commonly owned issued U.S. Pat. Nos. 5,337,221 and No. 5,343,374; and of co-pending U.S. Ser. No. 08/242,745 filed May 13, 1994, now U.S. Pat. No. 5,519,590; U.S. Ser. No. 08/242,746, filed May 13, 1994, now U.S. Pat. No. 5,595,440; and U.S. Ser. No. 07/820,486, filed Jan. 14, 1992, now U.S. Pat. No. 5,402,327, are incorporated by reference herein.

BACKGROUND OF THE INVENTION

A. Field of the Invention

The present invention relates to the lighting of relatively large areas or targets, and in particular, to the use of high intensity light sources to light such areas or targets in a highly efficient yet highly controllable manner.

B. Problems in the Art

There are many instances where highly efficient and highly controllable high intensity lighting could be advantageous. There are many known methods of high intensity lighting. Most utilize some sort of an arc lamp of relatively high wattage and a reflector system that attempts to direct part of the light from the arc lamp to a target area. An example is the widely used axially mounted arc lamp in a bowl-shaped hemispherical reflector. This type of known lighting is described in detail in U.S. Pat. Nos. 5,343,374 and 5,337,221.

Although this type of fixture can produce a relatively high intensity, controlled and concentrated beam, the nature of the fixture presents some difficulties with respect to efficiency and control. Such fixtures normally are elevated at least several tens of feet and then aimed towards the target location. Because the reflector is symmetrical, some light falls directly on the target area but other light falls outside the target area. Such light is known as spill light. It reduces the beneficial use of light because light which otherwise could be useful at the target area, and which is produced by the fixture, does not end up in the target area.

Additionally, even though such fixtures produce a relatively controlled, concentrated beam, the nature of light is such that even such a beam cannot be precisely collimated to long distances and therefore there is some beam spread and dispersion of light. It is therefore difficult to achieve sharp cutoff of the beam pattern from each of the fixtures at long distances and difficult to control the precise shape and other characteristics of the light. It is difficult to match the shape of the light from the fixture with the shape of the target area.

U.S. Pat. Nos. 5,343,374 and 5,337,221 show and describe apparatus and methods which address light control problems. Their preferred embodiments utilize a light fixture which can be, but is not required to be, a bowl-shaped reflector, a primary reflector, and an on-axis arc lamp. The light fixture is directed away from the target area into a mirror or secondary reflector. The mirror redirects at least a portion of the light from the primary light source. The nature of the combination is such that it produces a controlled beam with sharp precise cutoffs. Therefore, at a race car track as an example, these fixtures can be placed on the ground. Each fixture directs a light beam so that it covers the width of the track and yet cuts off at the top or very close to the top edge of the restraining wall of the outer edge of the track. The light is therefore placed on the track instead of off the track. It also is kept out of spectators' eyes. A plurality of such fixtures can be placed around the interior of the track and coordinated to produce even, uniform but controlled lighting for the track.

Although such systems do have efficiencies, there is still room for improvement regarding such devices and methods.

For example, the size of such apparatus is substantial. In the preferred embodiment described in U.S. Pat. Nos. 5,337,221 and 5,343,374, the light producing fixtures are essentially the same size as conventional bowl-shaped fixtures with on-axis arc lamps. For example, the reflector can be several feet in diameter at its face. The mirrors or secondary reflectors can be on the order of several feet tall by several feet wide and are spaced several feet from the light producing fixtures.

Additionally, those types of arrangements introduce difficulties regarding efficient utilization of light. All of the light from the light producing fixture may not be redirected by the secondary reflector or mirror. For example, some light from the light producing fixtures may fall outside the mirror and therefore be lost.

Also, the flexibility of these arrangements in terms of ease of positioning and adjustability is limited.

It is therefore the principle object of the present invention to provide a high efficiency, highly controllable light fixture and method which improves upon the state of the art.

A further object of the present invention is to provide an apparatus and method which efficiently utilizes light.

Another object of the present invention is to provide a highly controllable light for large areas from a relatively compact fixture.

Another object of the present invention is to provide flexibility with regard to operational characteristics such as adjustability of the characteristics of the light produced.

Another object of the present invention is to provide flexibility with regard to directing light to a target area.

These and other objects, features, and advantages of the present invention will become more apparent with reference to the accompanying specification and claims.

SUMMARY OF THE INVENTION

The apparatus according to the present invention includes a high intensity light source. A first or primary reflector is positioned at or near the light source and is substantially the same order of size as the light source. A second or secondary reflector of substantially larger size than the light source redirects direct light from the light source in a highly controlled manner to a target. The primary reflector redirects light from the light source back through the light source and/or to the secondary reflector for redirection in a highly controlled manner to the target area.

The light source, primary reflector and secondary reflector can be contained within the same housing. The housing can be attachable to a base which can allow adjustable orientation of the housing with respect to the target. The base can be either placed on the ground or connected to some structure, including a structure that would elevate the housing.

The method according to the present invention includes redirecting at least a portion of the light output of the light source back through the light source, the redirection occurring very close to the light source. Light directly from the light source, and any light that has been redirected back through the light source, is in turn redirected in a highly controlled manner to the target area.

The invention can be utilized in a single fixture or with multiple fixtures to produce light which is highly controlled and efficiently utilized for an area or target.

DETAILED DESCRIPTION OF THE PREFERRED EMBODIMENT

A. Overview

Figure 1:
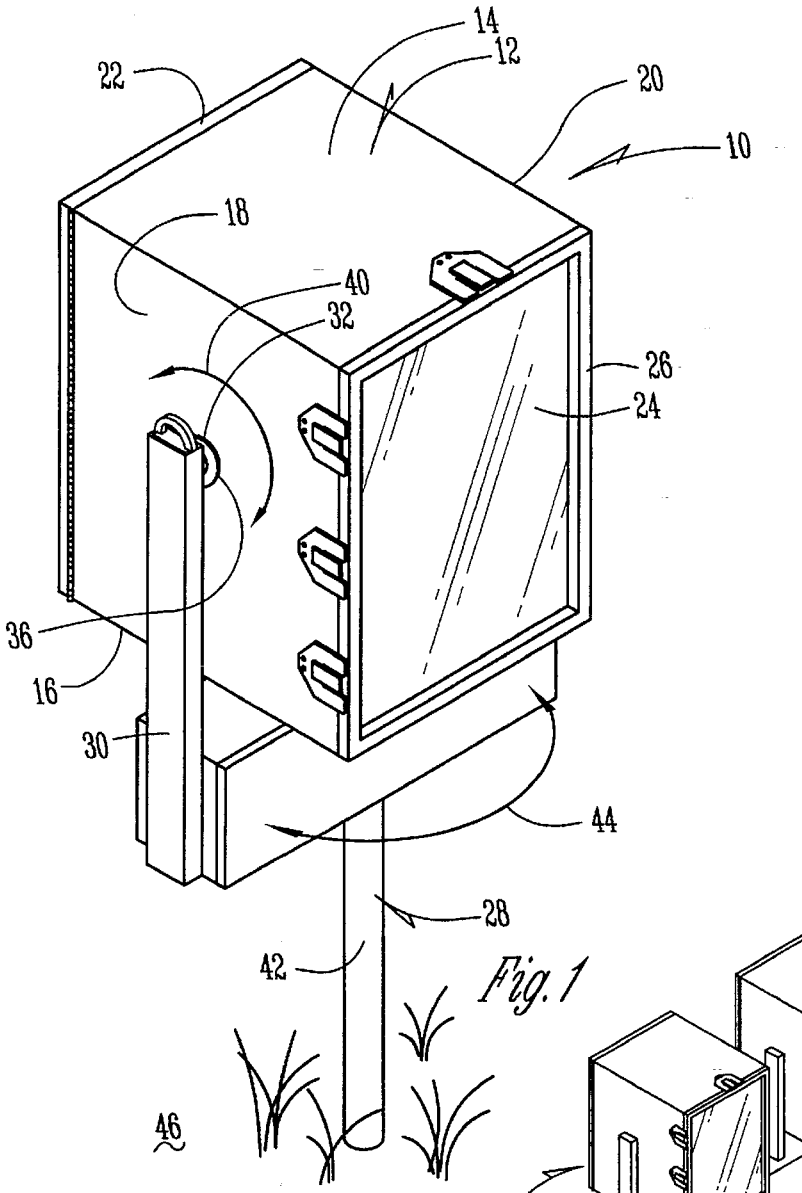
FIG. 1 is a perspective view of the front and right side of an apparatus according to the preferred embodiment of the present invention.

To better understand the invention, a preferred embodiment will now be described in detail. The preferred embodiment discussed is but one form the invention can take and does not and is not intended to limit the forms the invention can take.

Frequent reference will be taken to the appended drawings. Reference numbers will be used to indicate certain parts and locations in the drawings. The same reference numerals will be used to indicate the same parts and locations throughout the drawings unless otherwise indicated.

Examples of specific uses of the present invention can be found in U.S. Pat. Nos. 5,337,221 and 5,343,374. As an example, the present invention can be advantageously used for a target area such as a race car track. Other examples include sports field or court lighting, lighting of highways or intersections, and other uses where highly efficient and highly controllable hi-intensity lighting is needed or desired. The invention can be beneficially used in most lighting applications.

B. General Structure of Preferred Embodiment

FIG. 1 illustrates fixture 10 according to a preferred embodiment of the invention. A housing 12 has top 14, bottom 16, left side 18, right side 20, rear 22 (all of stainless steel), and front 24. It is to be understood in this embodiment that front 24 consists of a substantially transparent window or lens within a stainless steel frame 26 that is attached to and forms a part of housing 12. A base, designated generally at 28 is essentially a double trunnion in a sense that fork 30 is pivotably mounted to sides 18 (see pivot connection 32) and 20 of housing 12 to allow pivoting of housing 12 around a horizontal axis (see arrow 40) defined by pivot connections 32 (see FIG. 6); and fork 30 (having vertical spaced-apart arms extending from a trunnion box below housing 12) in turn is rotatable on post 42, defining a vertical axis (see arrow 44). Post 42 is in turn rigidly mounted in the ground 46 so that the entire fixture 10 can be placed near the ground. Alternatively, post 42, or some similar arrangement could be mounted upon almost any type of support, even those which are elevated. An example would be the mounting of several fixtures 10 on a cross-arm 48 elevated on pole 50 (see FIG.

Figure 1A:
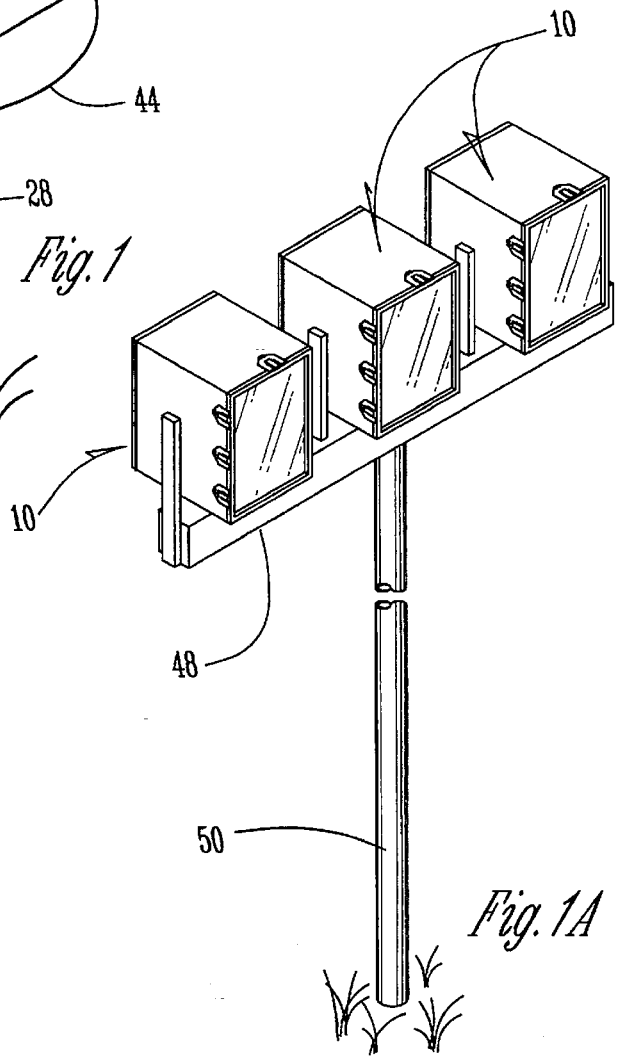
FIG. 1A is an elevational diagrammatical view of multiple apparatuses elevated on a pole.

1A). Each fixture 10 in FIG. 1A could be rotatable and/or tiltable. It is to be understood, however, that the use of a trunnion mount is not required and housing 12 could be mounted by a number of ways, within the skill of those skilled in the art, to some supporting structure or to any of a variety of types of bases.

As can be seen in FIG. 1, fixture 10 therefore is a self contained unit which produces a light output from components contained within housing 12.

In the preferred embodiment, housing 12 is 29¾" wide by 34" tall by 19¼" in depth. Other configurations and dimensions are of course possible. The materials used for housing 12 are not critical. They may be sheet metal. The materials for the parts of base 28 likewise are not critical. In the preferred embodiment they are made of metal bars and tubing.

Figure 2:
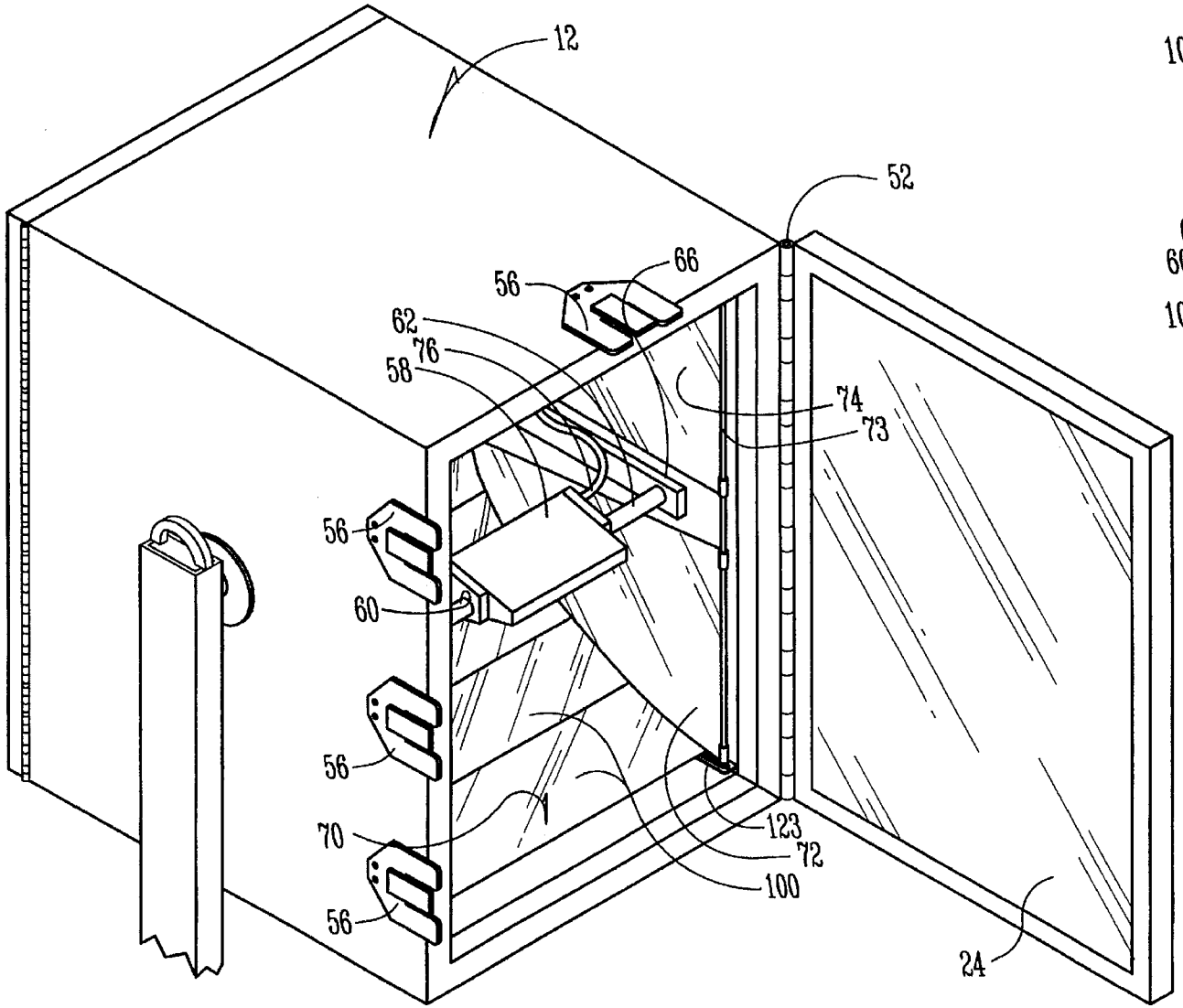
FIG. 2 is an enlarged isolated perspective view of the apparatus of FIG. 1 with the front lens shown in an open position. The large secondary reflector, and the mount for the light source and primary reflector are partially shown in the interior of the housing of the fixture.

FIG. 2 illustrates front lens 24 pivoted open on hinge 52 (with latches 56 released). Latches 56 are erected or otherwise connected to housing 12 and have a middle resilient finger with a lip at the end which holds door 24 shut. The fingers on each side of the middle finger deter frame 26 from being pulled sideways and putting bending pressure on the glass. The front door (lens 24) and front perimeter of housing 12 have extended mating lips and a silicone gasket to create a seal when closed. Latches 56 securely close door 24 but are easy to operate to open door 24. The interior of housing 12 includes what will be referred to generally as light source mount 58 (of metal or ceramic) suspended on oppositely extending steel rods 60 and 62 which are connected at outer ends to steel arms 64 and 66. A secondary reflector (designated generally at 70) is spaced apart from but positioned around one side of light source mount 58 opposite lens 24. The precise shape and size of reflector 70 can vary. For example, secondary reflector 70 could be made much bigger than shown in FIG. 2. Its ends could extend much farther forward and ahead of light source mount 58. However, sometimes increases in size of reflector 70 result in marginal benefits. Therefore, reflector size is minimized as much as possible without losing significant control of light. Optional side reflectors 72 and 74 (on each interior left and right side of housing 12) can also be utilized. Reflectors 72 and 74 are mounted in frames (not shown) which are attached to a vertical rod 73. Electrical power is supplied to light source mount 58 by wires 76. It is to be understood that other electrical components, such as ballasts, fuses, switches, etc., could be placed externally of housing 12, such as in the interior of trunnion fork 30, or in other enclosures. For example, the horizontal section of trunnion fork 30 (called the trunnion box) could house the ballasts and other components. Heat producing components, particularly ballasts, could be placed outside of housing 12 to reduce thermal problems for fixture 10.

Figure 5:
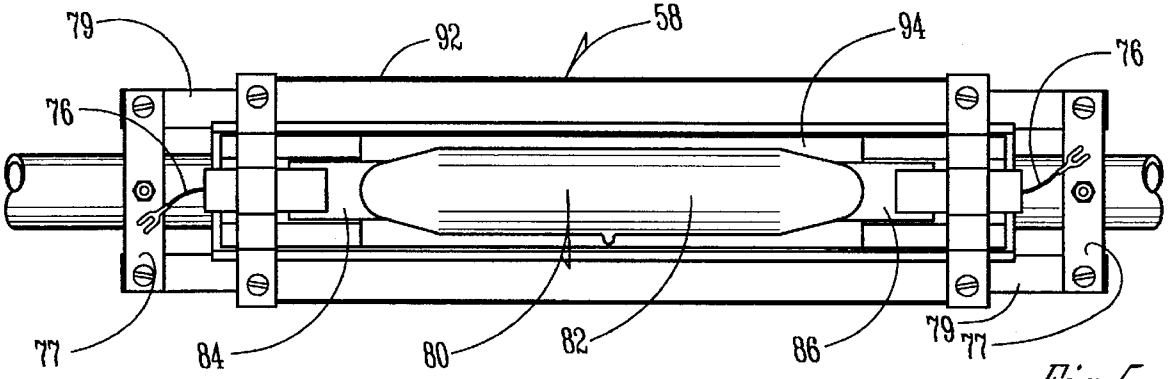
FIG. 5 is a rear elevational view taken along line 5—5 of FIG. 4.
Figure 3:
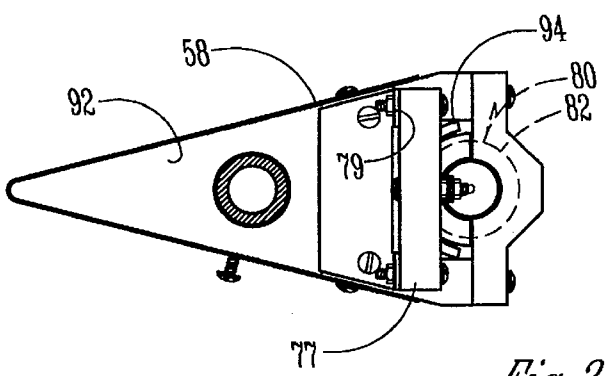
FIG. 3 is a side elevational view taken along line 3—3 of FIG. 4.
Figure 4:
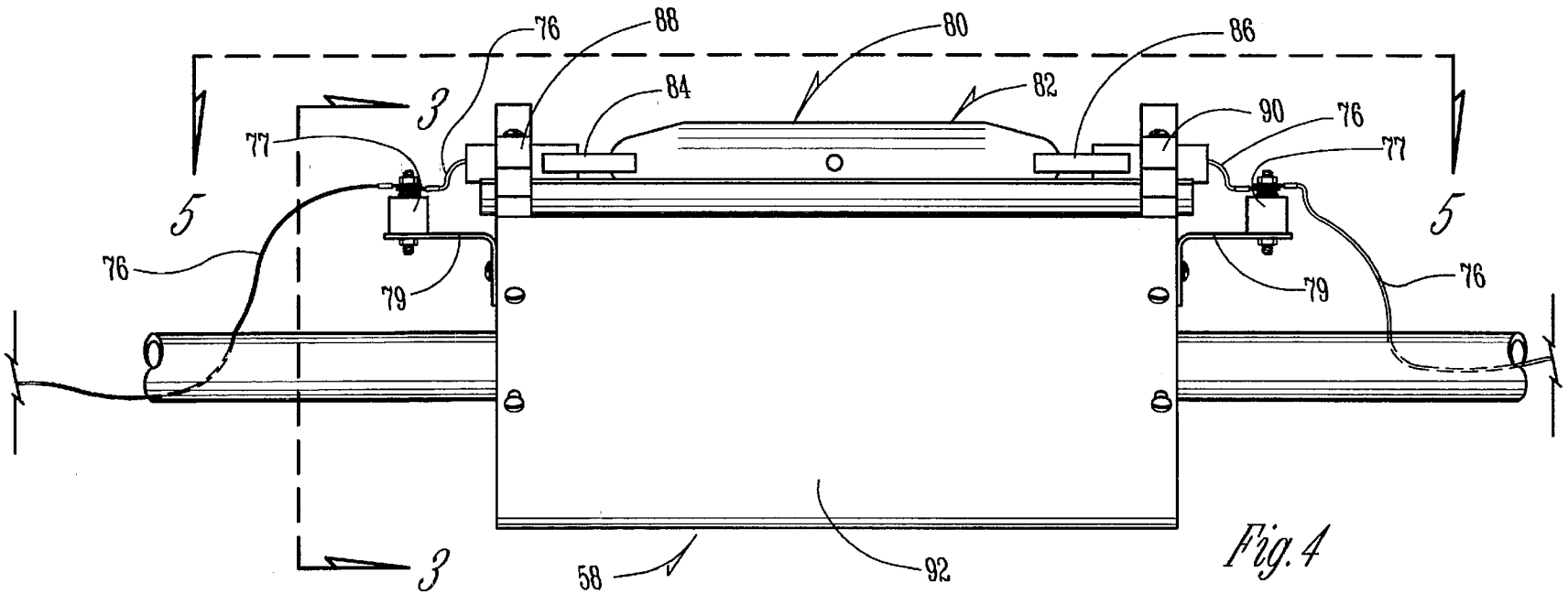
FIG. 4 is an enlarged top plan view of the light source mount of FIG. 2.

FIGS. 3–5 show in more detail the light source mount 58 and associated components. A light source 80, here an arc tube 82 (approximately 1⅛" diameter, 4½" long) surrounding electrodes 84 and 86, is positioned generally horizontally between arms 88 and 90 which extend rearwardly from mount body 92.

The rearward facing side of arc tube 82 is exposed and faces reflector 70. As shown in FIG. 3, the forward facing side of arc tube 82 is surrounded by a reflector 94 which is closely positioned or in abutment to and only slightly bigger than arc tube 82. Reflector 94 can be curved (see FIGS. 7A and 8), flat (see FIG. 7B), or form a coating or layer on arc tube 82 (see FIG. 7C). In the preferred embodiment it is on the order of 1⅛" tall by ⅛" thick by 11.0" tall.

By referring also to FIG. 2 along with FIGS. 3–5, it can be seen that mount body 92 effectively blocks arc tube 82 from view from the front of fixture 10. The rearward exposure of arc tube 82 and reflector 94 ensures that most or all of the direct light of arc tube 82 to reflector 70 is reflectively controlled by reflector 70. It is to be also understood that the shape and proximity of reflector 94 to arc tube 82 directs a substantial amount of light from arc tube 82, that does not go directly to reflector 70, back through the arc stream of arc tube 82 and/or to reflector 70.

In the preferred embodiment, arc tube 82 consists of a high intensity arc tube which is elongated and produces a somewhat elongated arc stream, as opposed to one that is closer to a point source of light. It is to be understood, however, that a shorter arc stream or shorter arc light source in the horizontal direction would produce a narrower beam from the fixture in horizontal directions. There are certain high intensity light sources that have quite narrow arc streams for light sources. Some HMI lamps are of that nature. Wires 76 connect to electrodes 84 and 86 as shown. Insulators 77 and brackets 79 can be used to suspend and support wires 76.

It is to be understood, however, that different types, shapes, and characteristics of light sources can be used with the present invention. The above preferred embodiment is useful in applications such as lighting race tracks where the elongated light source used with elongated rectangular mirror segments, as described in a more detail later, can create very sharp defined cutoffs, particularly at the top of the beam.

Vertical beam spread for the preferred embodiment is a function of the diameter of the arc tube 82 and the distance between the arc tube and the vertex of reflector 70. The widest part of the beam is determined by light rays which are traced from the top and bottom of the arc tube to the vertex of the reflector and their respective reflective directions. Light rays from any position of the arc tube to any other position on reflector 70 will fall within the vertical beam spread defined by the rays from the top and bottom of the arc tube reflecting from the vertex of the reflector. In the preferred embodiment, reflector 70 has 4" by 24" segments 100 positioned along a parabola defined by the equation $y_2=4fx$, where maximum x=8¾", f=6 ½", and maximum y=15". There is about a 30" distance between the top front edge and the bottom front edge of reflector 70 (the chord between the opposite ends of reflector 70). When installed there is about approximately 5/32" separation between adjacent edges of segments 100. For a 10° vertical beam spread, arc tube 82, having a 1⅛" diameter, and a distance of 4" between electrodes, is placed about 6½" from the vertex along the focal length of reflector 70.

It is therefore to be understood that by increasing the diameter of the light source, a wider beam can be created. Alternatively, moving the light source near reflector 70 could create a wider beam. The converse is also true. A smaller diameter arc tube or placing the arc tube farther from reflector 70 can narrow the beam. If the position of the light source is changed it would defocus the beam. The segments would have to be re-aimed and/or the size of the parabola changed. A feature of fixture 10 is that beam width vertically can be adjusted to some degree without changing the position of the light source relative to reflector 70 by adjusting segments 100.

It is also to be understood that because of the above described relationship, the entire fixture can be made smaller or must be made larger depending on the distance between the light source and the reflector. If the diameter of the light source can be made very small, it can be placed nearer reflector 70 than one of a larger diameter. This would shorten the distance. This shorter distance would then allow a reduced size fixture.

As will be described in more detail below, utilization of segments to make up mirror 70 allows an alternative way to widen or narrow a vertical beam spread. Each segment is individually adjustable in its orientation to the light source by being pivotable around a horizontal axis. By creating a greater angle of incidence of light from the light source to a segment, a wider beam can be created. This assists in the adjustability and flexibility of fixture 10.

For a racetrack of a size suitable for NASCAR stock cars, a 10° vertical beam spread was selected. There is not as much concern about cutoff on the sides of the beam because the track is long in both directions. The relationship between the light source, the primary reflector, and the secondary reflector, as far as size, shape, and spacing, all can be adjusted or selected to create certain lighting effects. In many instances, it is advantageous to match the beam shape with the target. Correlating the shape of the secondary reflector mirrors with the shape of the beam allows this to take place. In the example of the preferred embodiment, this is done by having parallel surfaces between the bottom of arc tube 82 and the top of each mirror segment of secondary reflector 70, and then using somewhat linear light source 80 and rectangular mirror segments. Other shapes and relationships can be used to create other desired lighting effects.

In the preferred embodiment a 2,000 watt metal halide arc tube is utilized. Other types or wattages of lamps can be used. Wattages as low as 250 watts or even less are possible. There is no limitation on the wattage type or size of light source.

Reflector 94 is placed next to the outside of arc tube 82 and is specifically coated to pass infrared radiation but reflect 85% of visible light. Thus, the infrared radiation is not reflected back through the arc tube 82 thus reducing heat to the seals or the hot points near the electrodes, but 85% of visible light is reflected back through the arc stream and/or to reflector 70.

Figures 7A, 7B, 7C, 9A:
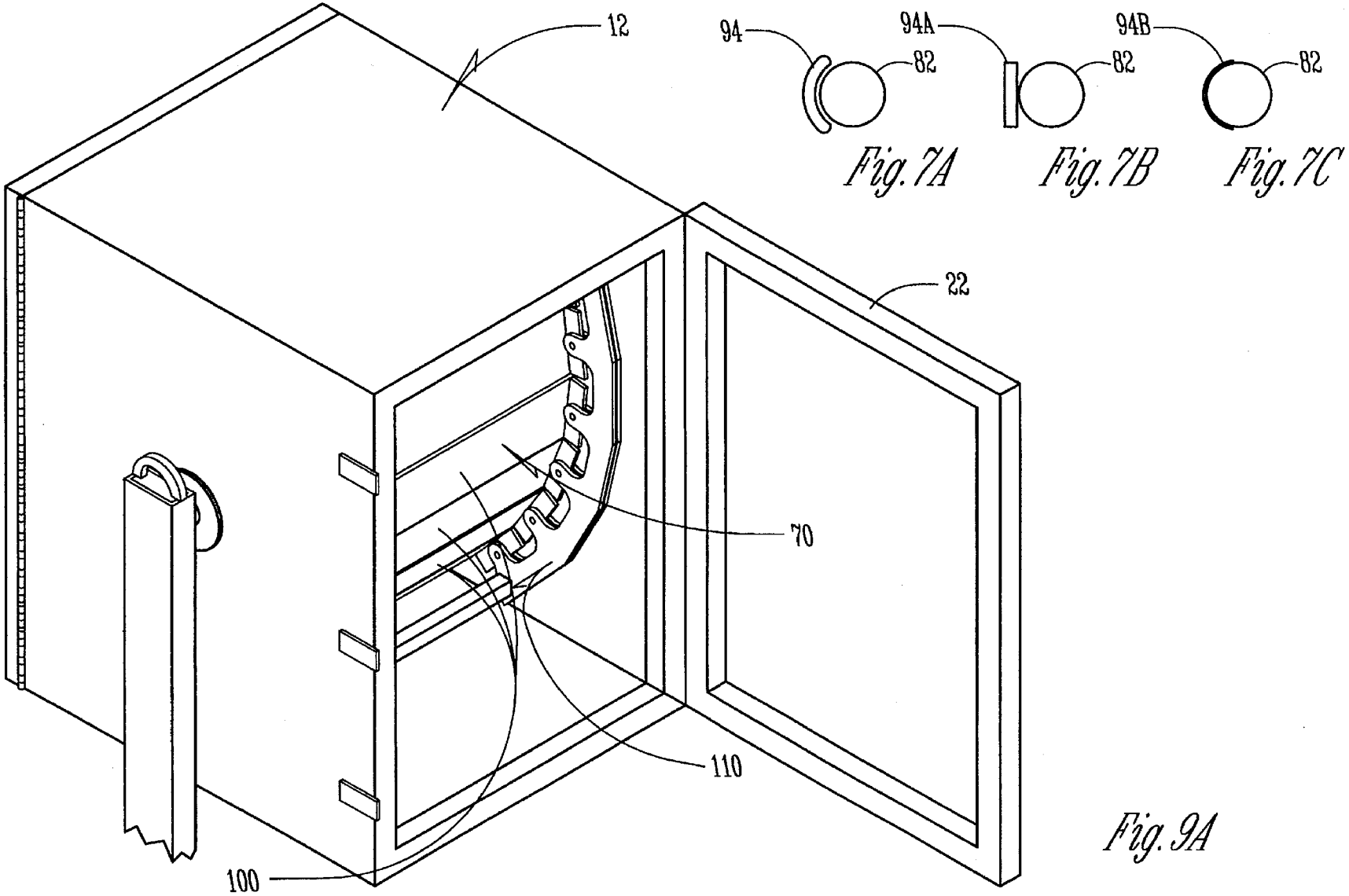
FIG. 7A is a side elevational diagrammatic view of a light source and a curved, separate primary reflector.
FIG. 7B is side elevational diagrammatic view of a light source and a flat, separate primary reflector.
FIG. 7C is a side elevational diagrammatic view of a light source and a primary reflector in the form of a coating.
FIG. 9A is an enlarged perspective view of the housing of the fixture of FIG. 9, showing the rear wall pivoted open and the back of the frame that supports the secondary reflector.
Figure 8:
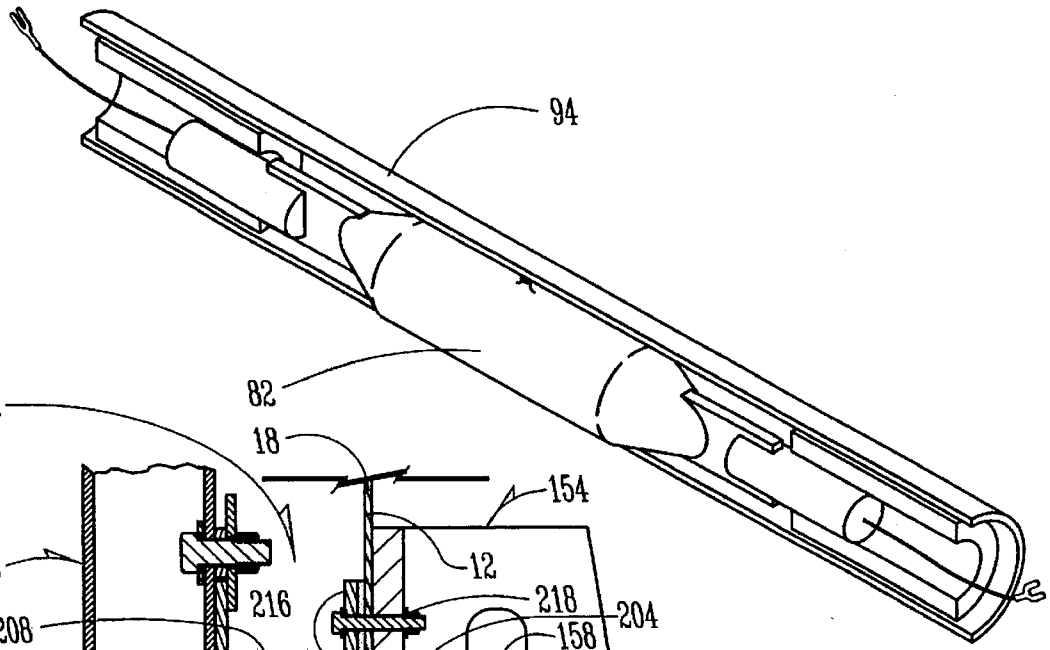
FIG. 8 is an isolated perspective of an embodiment of a light source and primary reflector.

As shown in FIG. 3, reflector 94 is made to match the perimeter of arc tube 82. Alternatively, it could be flat (FIG. 7B) or some other shape. It could be spaced slightly therefrom or alternatively it could be a direct coating on arc tube 82 (FIG. 7C). For example, it could be a dielectric, dichroic (passes certain wavelengths of light and reflects others) or ceramic material such as aluminum oxide.

The curved reflector shapes of FIGS. 7A and 7C generally allow more control of light and will produce a narrower beam than a flatter or larger reflector 94 such as shown in FIG. 7B. However, there may be instances where a wider beam is required or desired and thus a flat or less curved reflector 94 could be used. Furthermore, curved reflectors 94 such as FIG. 7A and 7C can create thermal problems which can affect arc tube 82, such as heating of the seals or other heating problems, or can affect reflector 94 such as degrading any bonding or fusing that is needed to place reflector 94, either as a separate piece or as a coating, upon the perimeter of arc tube 82. Therefore, a material which passes infrared radiation but reflects a substantial amount Of visible light, may be advantageous.

Reflector 94 is relatively close to and relatively similar in size to arc tube 82. As compared to the primary reflector described in U.S. Pat. Nos. 5,337,221 and 5,343,374, by placing reflector 94 at this position relative to arc tube 82 and making it that size, the whole size of the fixture can be reduced significantly.

It is therefore generally advantageous to minimize reflector 94 in size relative to the light source. Reflector 94 is also generally very small relative to the secondary reflector 70. Again, this helps to minimize the size of the entire fixture.

It is to be understood, however, that reflector 94, the primary reflector, can be very specular. However, it can also be diffuse, such as made of ceramic or a ceramic coating, such as aluminum oxide.

Figure 6:
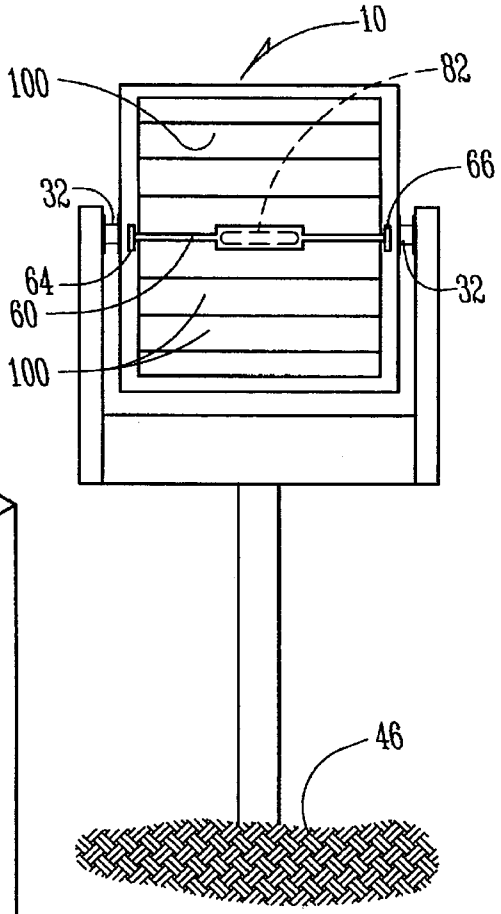
FIG. 6 is a simplified reduced front elevational view of FIG. 2.

FIG. 6 shows a front elevational view of fixture 10. By referring also to FIG. 2, it can be seen that individual segments 100 are placed side by side along a curve in the vertical plane. Each segment 100 extends generally horizontally across the width of the interior of housing 12. The segments basically surround over 180° of the suspended light source 80. As will be explained later, the position of segments 100 relative to light source 80 is such that they redirect and project light out of lens 24 in a highly efficient and controlled manner.

Figure 9:
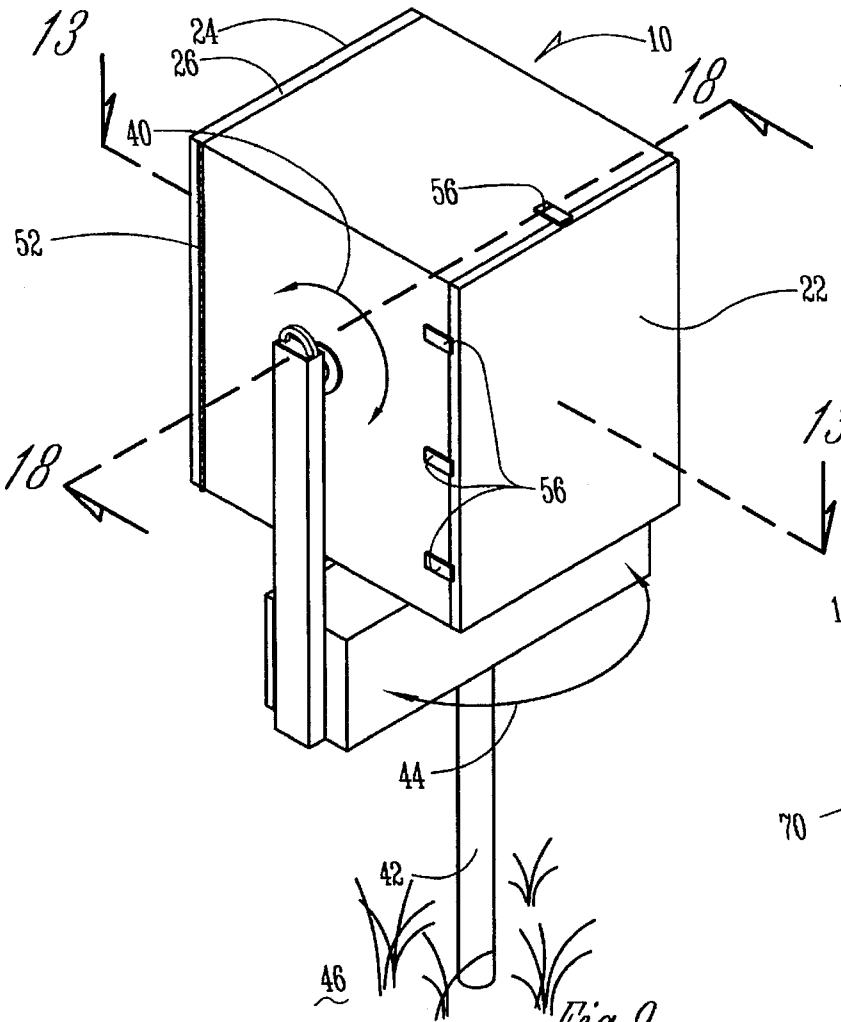
FIG. 9 is a perspective view of the rear and left side of the apparatus of FIG. 1.

FIG. 9 illustrates a rear perspective view of fixture 10, and shows rear panel 22, which is like front panel 24 in that it can be pivotable attached in a closed, sealed position by latches 56. By referring to FIG. 9A, rear panel 22 can be pivoted open to have access to the back of reflector 70. As is shown in FIG. 9A, a frame 110 is used in the preferred embodiment to create the parabolic shape of reflector 70 and to hold the individual segments 100 in place. Frame 110 is thus in turn mounted to housing 12.

Figure 10:
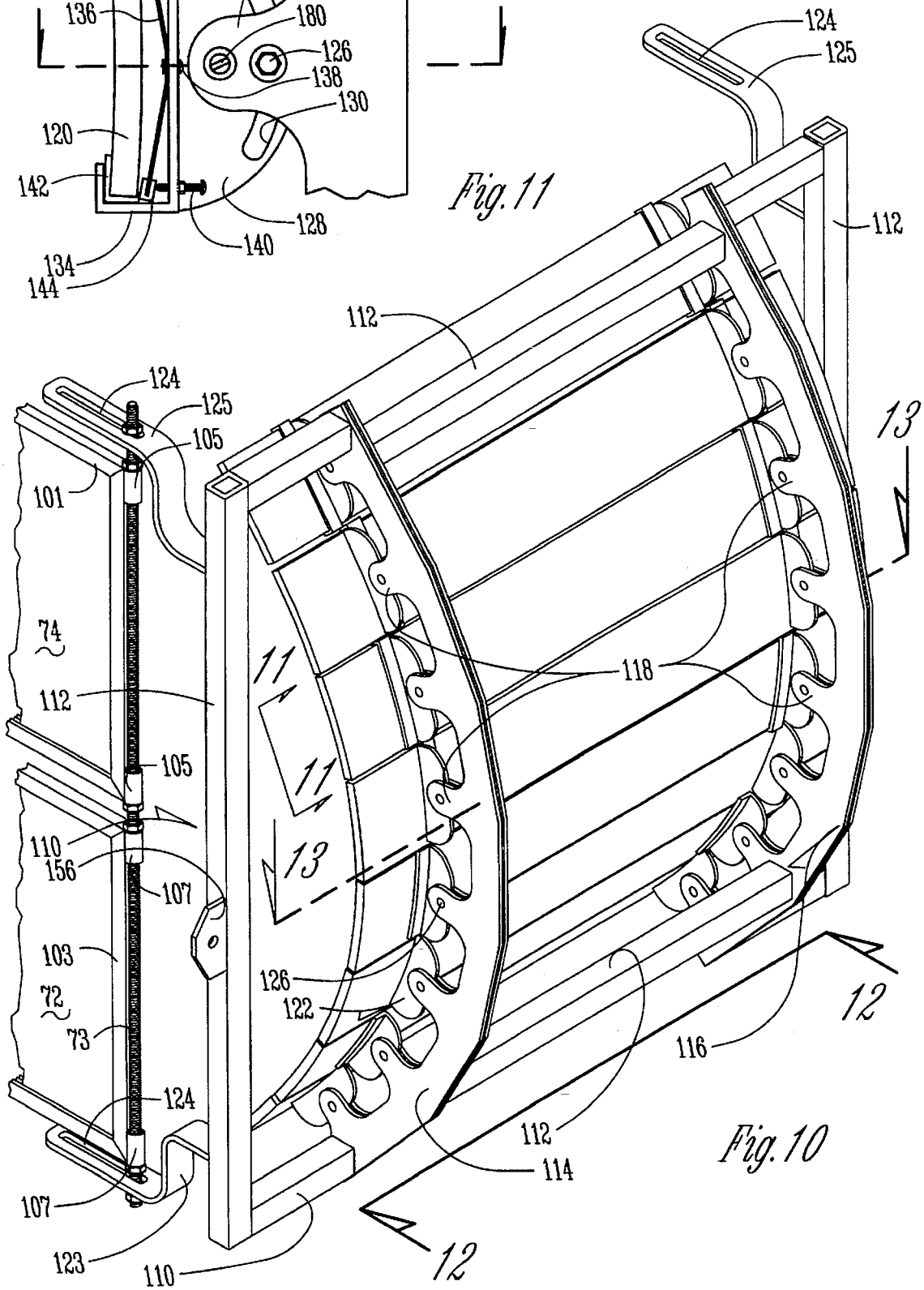
FIG. 10 is an enlarged isolated perspective view of the reflector frame with attached segments of the secondary reflector.

FIG. 10 shows frame 110 in more detail. A generally rectangular sub-frame 112 has two curved frames 114 and 116 attached to it. Frames 114 and 116 follow a parabolic line 106 (see FIGS. 14A and 14B). Ears 118 project outwardly along each curve 114 and 116 and are matched so that a segments 100 can be connected between corresponding ears 118 along curves 114 and 116.

FIG. 10 also shows that mounting brackets 122 are attached to each ear 118 and served to support one end of a mirror segment 100. Also side mirror mounts 123 and 125 extend forwardly from each side of frame 110 and includes slots 124. Each pair of mounts 123 and 125 receive opposite ends of vertical rod 73 (see FIG. 2). and allow side mirrors 72 and 74 to be mounted inside housing 12. Side mirrors are pivotable around rods 73 to alter their position to in turn affect the horizontal width of the light beam leaving fixture 10.

Figure 11A:
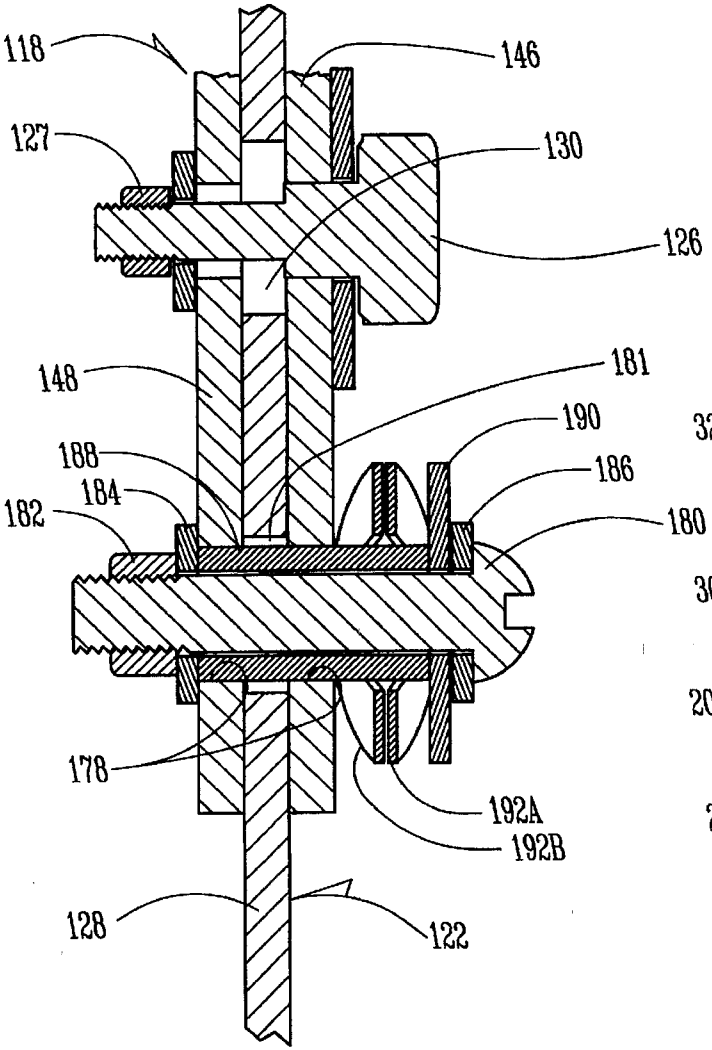
FIG. 11A is a sectional view taken along line 11A—11A of FIG. 11.
Figure 11:
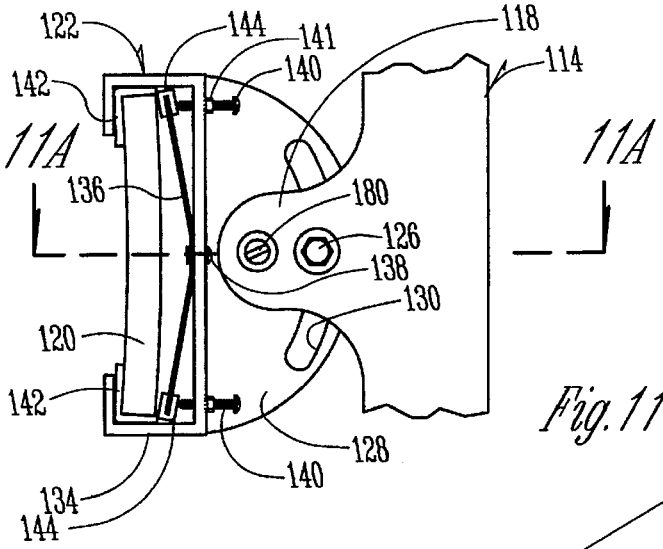
FIG. 11 is an enlarged side elevation of one mirror segment and connection components of one end of the segment to the frame of FIG. 10 taken generally from the viewpoint of line 11—11 of FIG. 10.

FIG. 11 shows in more detail the structure of bracket 122. A flange 128 of bracket 122 fits between halves of ear 118. A screw 180 and bushing 188 (see FIG. 11A) extend through aligned apertures in ear 118 and flange 128, and present a pivot axis upon which bracket 122 can pivot. A carriage bolt 126 is placeable through aligned apertures in the two matching halves of ear 118 and a curved slot 130 in flange 128. Bolt 126 is securable by a nut to lock bracket 122 in position. The range of tilt of bracket 122 is defined by slot 130. Thus, until bolts 126 of the brackets 122 holding opposite ends of a mirror segment 100 are tightened, the mirror segment 100 can be tilted over a range commensurate with the allowed range of movement of bolts 126 in slots 130.

FIG. 11 also shows an arrangement by which mirror segments 100 can be mounted to bracket 122 with precision and with reduced risk that there will be any forces applied to relatively fragile mirror segment 100 that would break it because of such mounting. It also allows relatively easy and quick insertion or removal of a segment 100. Bracket 122 has a main portion 134 which is C-shaped in cross-section. Flange 128 extends from one side of main portion 134. Mirror segment 100 mateably fits within and can slide into main portion 134. A flat spring 136 can be anchored by bolt, rivet, or other fastening member 138 to bracket 122 and be shaped so that its outer opposite ends extend to top and bottom edges on the back side mirror segment 120. Screws 140 can then be threaded down through nuts 141 projection welded onto the back side of main portion 134 of bracket 122 and push the opposite ends of spring 136 against the back of mirror 120. Pads 142 can be placed between the front side and top and bottom edges of mirror 100 and the jaws of main portion 134 and Teflon blocks 144 can be placed on the ends of spring 136 to provide some cushioning and protection of mirror 100 from the forces exerted upon it by this arrangement. The Teflon stands the heat generated inside fixture 10 by light source 80.

It is to be understood that by applying pressure to the top and bottom edges on the back of mirror segment 100 against the front jaws of main portion 134 of bracket 122, that a secure mount of segment 100 to frame 110 is accomplished plus the segment can be easily taken in and out. It also reduces the risk of applying forces or torque on mirror segment 100 which might lead to cracks or breakage or bowing of segment 100.

It is noted in. FIG. 10 that main body 134 of each bracket 122 extends on one side of flange 128 of bracket 122. In the arrangement shown in FIG. 10, brackets 122 are positioned on one segment 100 to both face one direction regarding main portion 134, and on the following segment 100 face another direction. This allows the segments 100 be placed closely adjacent to one another and when fine adjustment of the pivoting of each segment is done, brackets 122 will not interfere with one another.

FIG. 11A sets forth in detail the attachment of bracket 122 to an ear 118 of frame 110. Split halves 146 and 148 of ear 118 allow the insertion of flange 128 of bracket 122 between them. When slot 130 (see FIG. 11) of flange 128 aligns with apertures through each of halves 146 and 148 of ear 118, carriage bolt 126 is inserted through all of those pieces. By referring to FIG. 11A, it can be seen that a bushing 188 (50% compression) is inserted through aligned apertures 178 through halves 146 and 148 of ear 118 and an aperture 181 in flange 128. Outside washers 186 and 184 one at opposite ends of bushing 188. Both washers 186 and 184 are number 10 washers. A 5/16" washer 190 in between washer 186 and one end of bushing 188. A Bellville washer 192A, and a Bellville washer 192B are positioned as shown between washer 190 and the outer side of portion 146 of ear 118.

Bushing 188 is a precise pivot. Screw 180 and nut 182 are tightened just enough to compress washers 192A and 192B. Washers 192A and 192B then exert enough pressure to provide enough clamping force of the halves of ear 118 onto flange 128 of bracket 122 to allow easy and precise pivoting of flange 128 in ear 118, but once any pivoting is done, the bracket 122 stays in that exact location. Therefore, the arrangement of FIG. 11A gives enough tension so that segments can be quickly, smoothly, precisely, and easily adjusted, but stay in place until carriage bolts 126 are tightened.

The locking of each bracket 122 to ear 118 by tightening of nut 127 on carriage bolt 126 can be done without affecting the precise alignment of segment 100.

Figure 12:
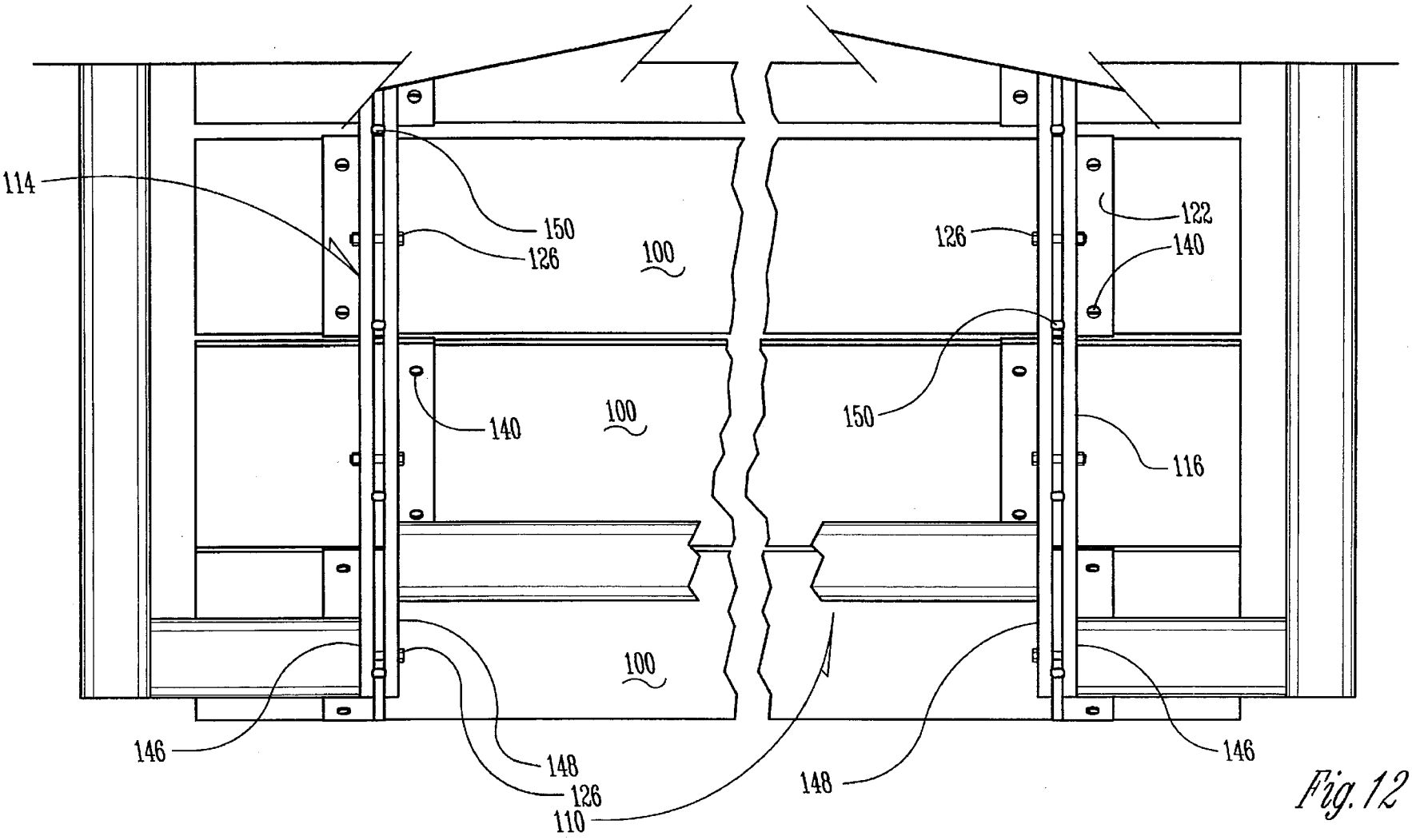
FIG. 12 is an enlarged partial back elevation of FIG. 12 taken along line 12—12 of FIG. 10.

FIG. 12 illustrates in more detail frame 110, and in particular curved frames 114 and 116. Each curved frame 114 and 116 actually consists of an outer half 146 and inner half 148 that are held in slightly spaced apart positions by spacers 150 (spot welds on the rear edges of halves 148 and 146 so that halves 148 and 146 at the location of ears 118 can resiliently move towards one another). Flanges 138 of mounting brackets 122 can then be fit between the space of halves 146 and 148 at the location of each ear 118.

Figure 13:
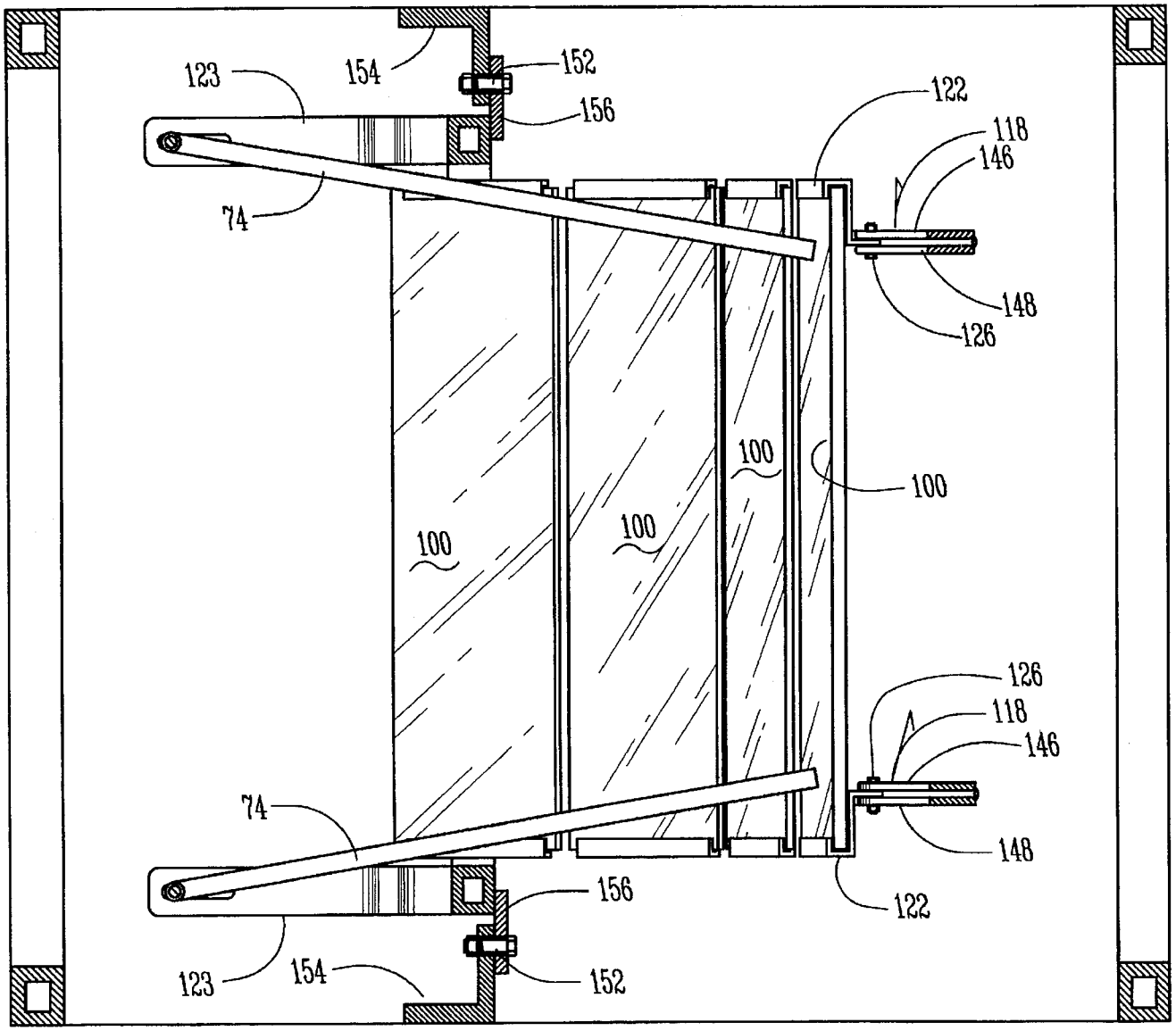
FIG. 13 is an enlarged sectional view of part of the interior of the housing of FIG. 9 showing the positioning of the large reflector frame in the housing, taken generally along line 13—13 of FIG. 9.

FIG. 13 shows in more detail several items associated with fixture 10. The right side of FIG. 13 shows connection of brackets 122 to ears 118 in more detail. The left side of FIG. 13 shows mounts 123 and mirrors 74.

Figure 16:
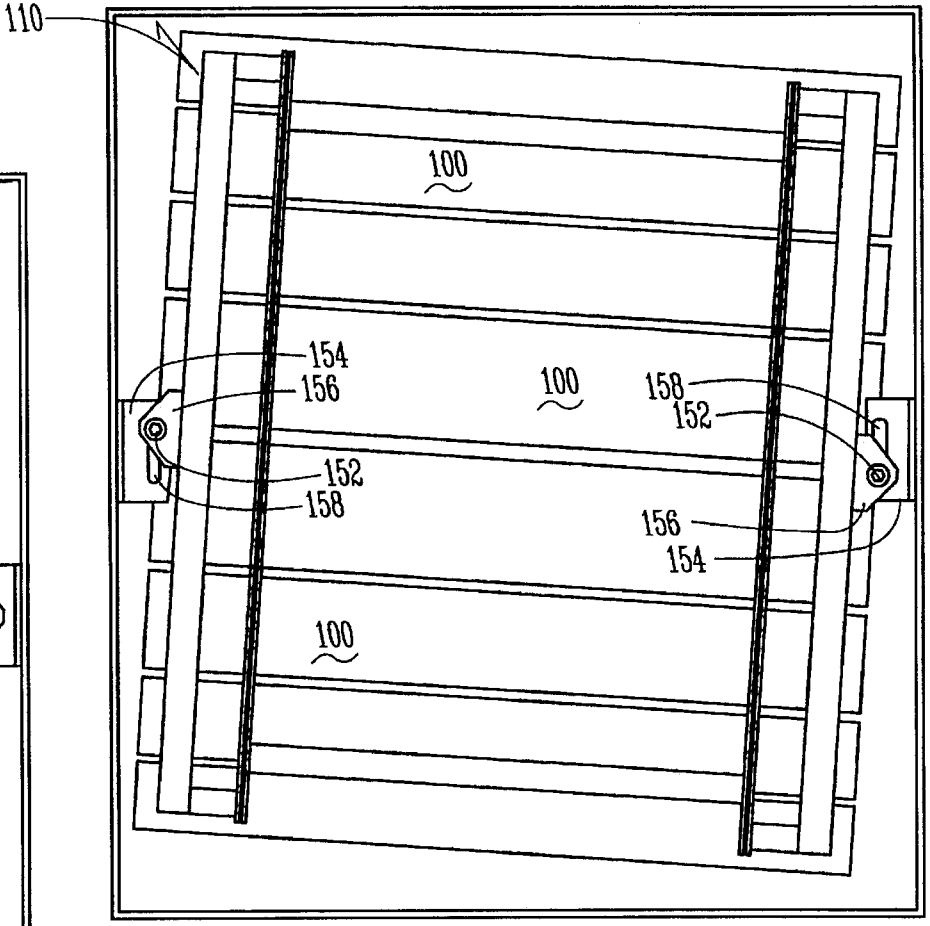
FIG. 16 is a similar view to FIG. 15 but showing the frame of FIG. 10 adjustably tilted in the fixture.
Figure 15:
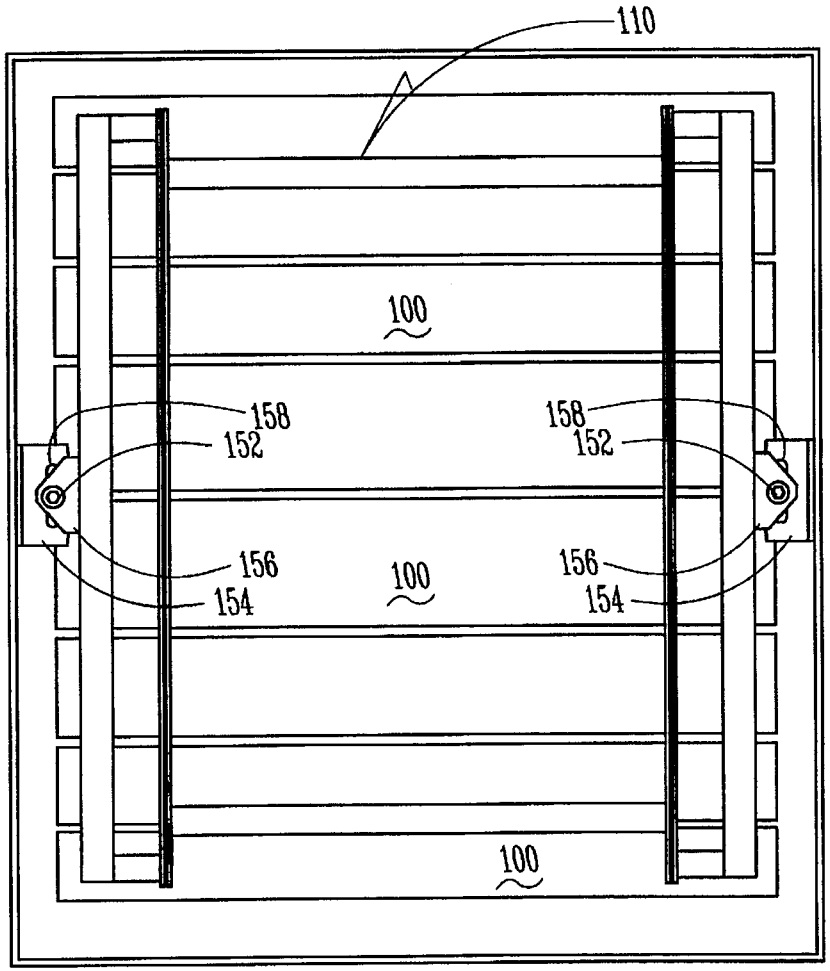
FIG. 15 is a rear elevational view of the interior of the fixture housing with the rear wall removed, showing the mounting of the secondary reflector on brackets allowing the adjustability of the frame of FIG. 10 in the fixture.

FIG. 13 also shows how frame 110 is secured by bolts 152 to brackets 154 which are fixed to the inside of housing 12. Brackets 156 (see also FIG. 10) are fixed to and extend outwardly from the sides of frame 110. As can be seen in more detail in FIGS. 15 and 16, vertical slots 158 exist in brackets 154. Thus, as shown in FIG. 16, the entire frame 110 can be tilted by loosening bolts 152 and tilting frame 110 either to the right as shown in FIG. 16 or the left. FIG. 15 shows frame 110 and basically is in centered position. Bolts 152 can be used to tighten frame 110 into a desired position.

Figure 14A:
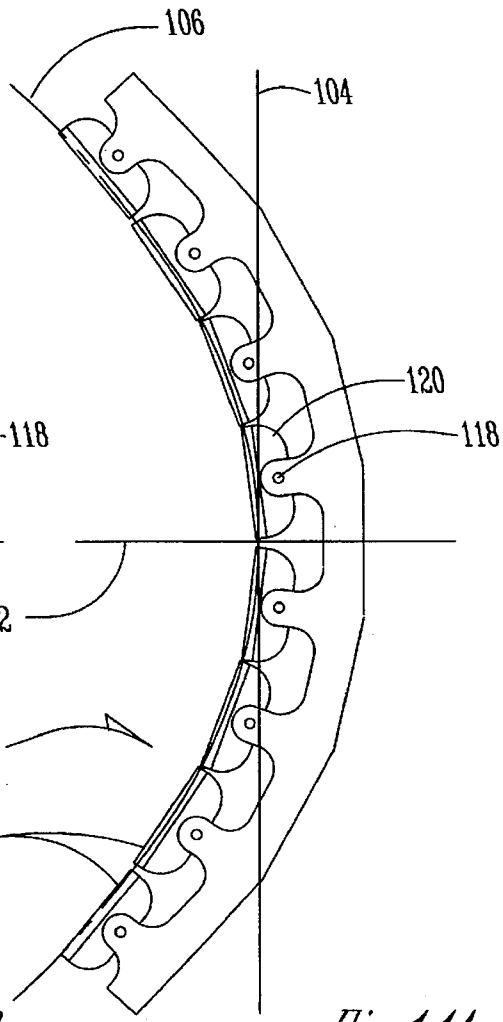
FIG. 14A is an enlarged isolated view of the elevational side of the large secondary reflector and frame, showing diagrammatically the line along which individual reflector segments are situated.

FIG. 14A provides a preferred cross-sectional shape of reflector 70 and how segments 100 are coordinated with that shape. It is preferred that the shape be parabolic. As shown in FIG. 14A, lines 102 and 104 represent the X and Y axes. Line 102 is the plane that passes through the center of the parabolic curve 106' (taken from a side elevational cross-section) of reflector 70. Although different parabolic shapes can be used, a preferred shape is defined by the equation $X^2=4fy$, where x equals horizontal distance, y equals vertical distance, and f is the focal point. FIG. 14A shows that once curve 106 is selected, individual segments 100 are placed side by side in an orientation to closely conform with curve 106. In the embodiment shown in FIG. 14A, segments 100 are flat four inch tall mirrored segments. Each one is placed so that it is as close as possible to a fit of the line 106.

In the preferred embodiment segments 100 are made of glass which has a mirrored back surface. These segments are highly specular (such as a mirror) with a minimum of diffusion. Less specular reflecting surfaces can be used. The amount of secularity depends on how much control is needed. In the race track example, high control is needed to get a very defined cutoff over a small distance between the light put on the track and the spectators. A mirrored back surface of a piece of glass is called a second surface mirror because the mirror is at the back side (the second surface) of the glass. Some reflection of light from the front or first surface of the glass takes place (around 4% of incident light). Some reflection also takes place from the second surface of the glass (also around 4% of incident light). Second surface mirrors are used because even though the glass reflects some light, and a small amount of light is lost by absorption, the glass will absorb ultraviolet radiation which could burn human eyes if reflected into them. A minimum amount of light will be lost because the reflections from the first and second surfaces of the glass will go in the same direction as light reflected from the mirrored surfaces. Also, the mirrored surface is fragile. Therefore, by placing it on the back of the glass, segments 100 can be cleaned without scratching or affecting the mirrored surface. It is to be understood, however, that first surface mirrors could be utilized. Reflection or absorption problems caused by the glass are avoided.

Figure 14B:
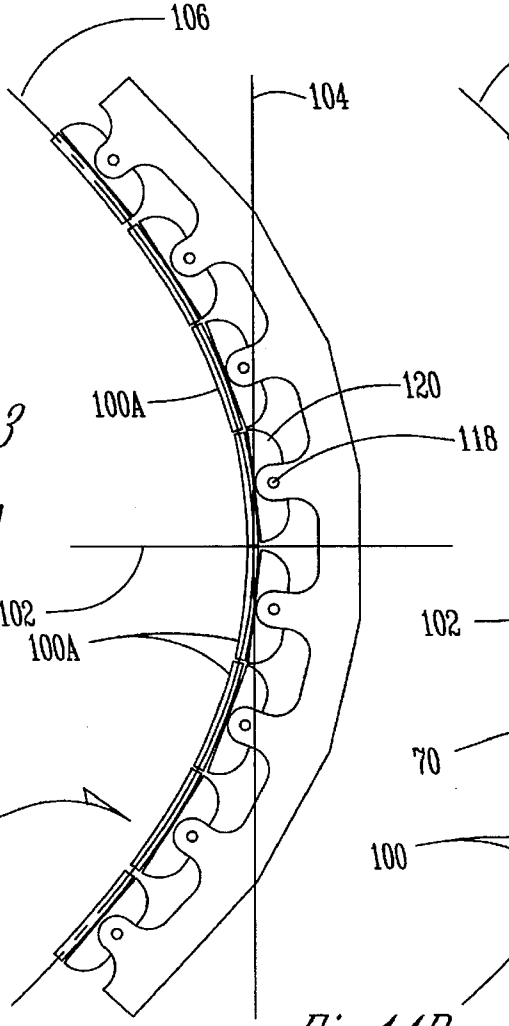
FIG. 14B is similar to FIG. 14A but shows alternative reflector segments to those of FIG. 14A.

FIG. 14B is identical to FIG. 14A except it shows an alternative to segments 100 of FIG. 14A. It may be preferable to more closely follow the curvature of parabola line 106 with the mirrored segments 100. Therefore, because flat mirrored segments 100 only approximate that curvature, especially where curvature is more significant at the middle of the parabola, segments 100A could be used which are curved in vertical cross-section to match the curvature at each individual location along line 106. Therefore, segments 100A at the outermost ends of parabola 106 would be less curved than those near the center.

The specifics of how each segment 100 or 100A is attached to a brackets 122 are shown in more detail in FIGS. 10–14A and 14B.

Figure 17:
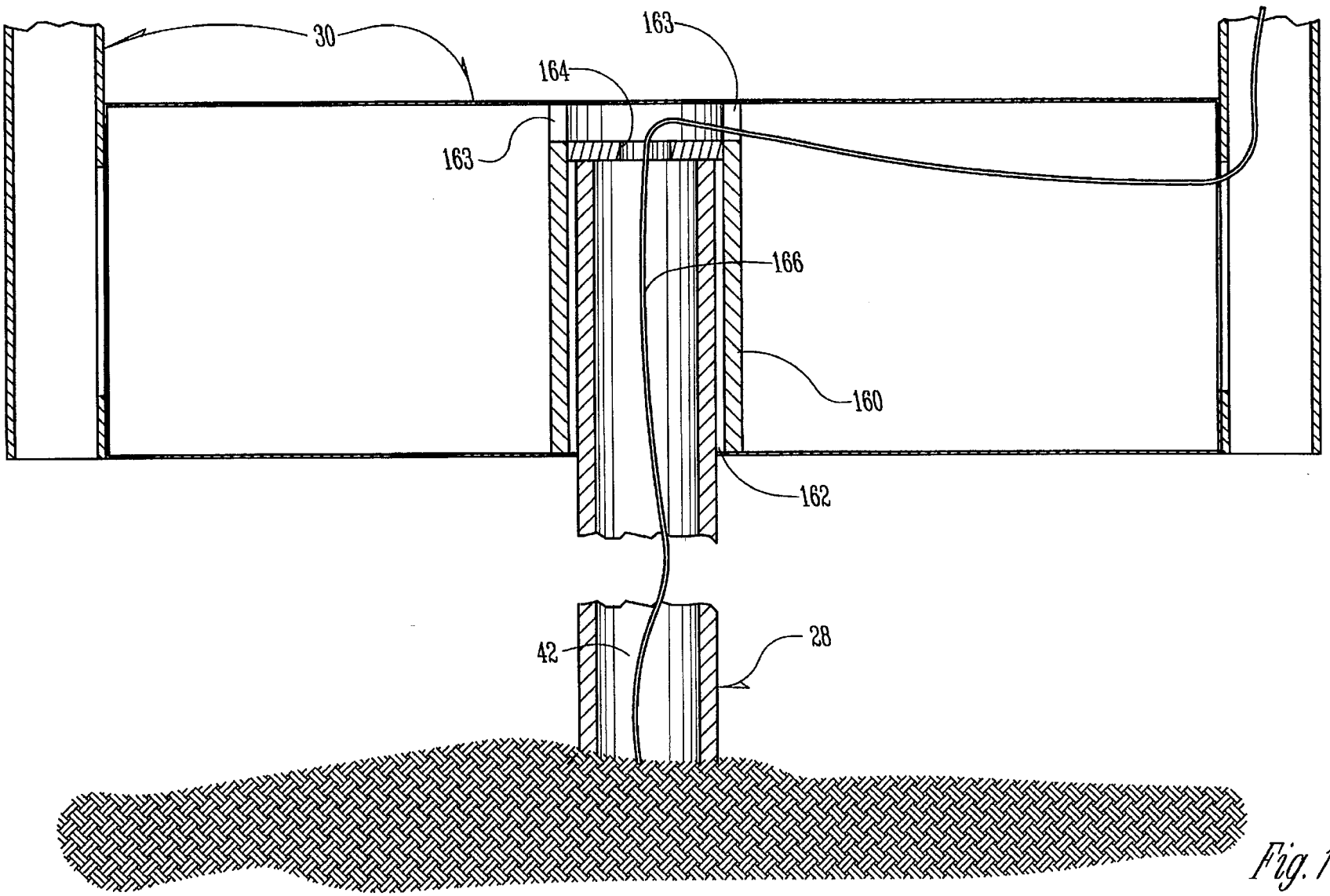
FIG. 17 is a vertical sectional view through the fixture of FIG. 1 showing how the support pole is mounted to the lower trunnion box.
Figure 19:
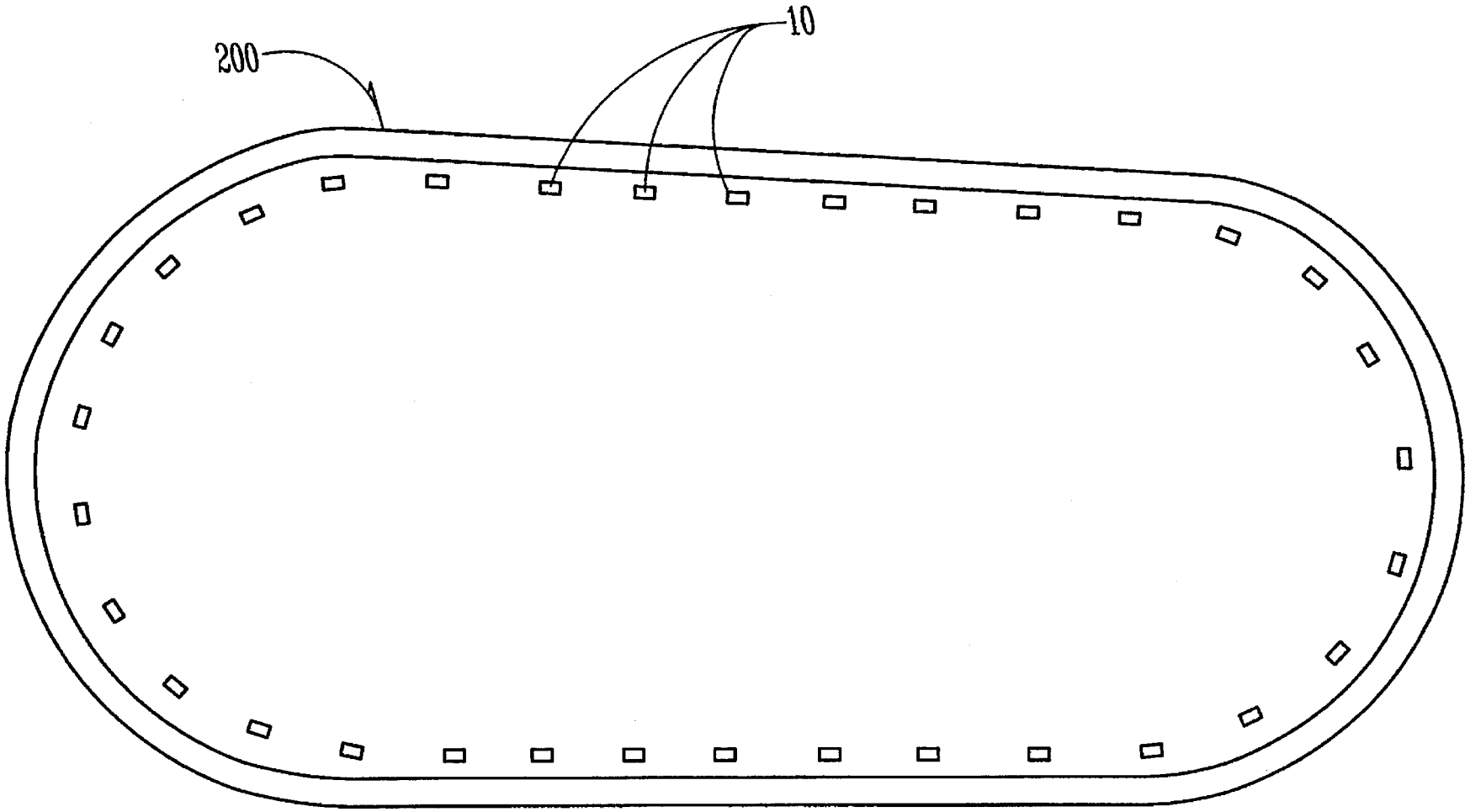
FIG. 19 is a top plan view of a race track showing diagrammatically one example of positioning of apparatus according to FIG. 1 around the interior of the track.

FIG. 17 illustrates the mounting of fork 30 to post 42. A segment of tubing 160 is welded or otherwise secured around an aperture 162 in the bottom of the horizontal cross-member of fork 30. The top of tubing 160 is closed except for an aperture 164. The diameter of post 28 is slightly smaller than aperture 162 and the inside diameter of tubing 160. The fork 130 can then be seated down upon post 42. Aperture 163 and allows wiring 166 to pass out of fork 30 into post 42 and down into the ground.

Figure 18:
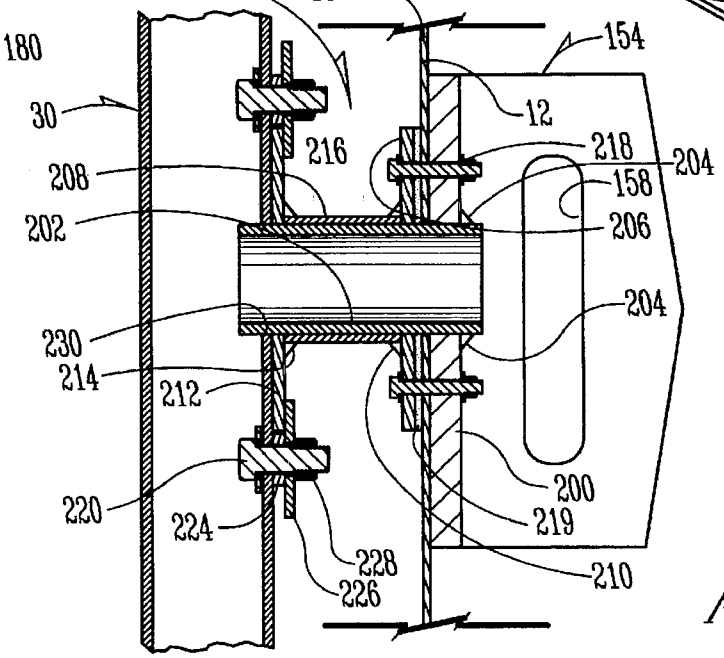
FIG. 18 is a sectional view taken along line 18—18 of FIG. 9.

FIG. 18 shows in detail a pivotal connection 32 between fork 30 and housing 12 of fixture 10. In this embodiment, bracket 154 which is used to tiltably adjust frame 110 inside housing 12, is used as a part of pivot connection 32. Plate 200 of bracket 154 abuts and is parallel to the inside side wall 18 of housing 12. An inner tube 202 is welded (at 204) to plate 200 and extends through an aperture in housing 12 outwardly. A plate 206 and an outer tube 208 and a still further plate 212 surround the outside of inner tube 202. Plates 206 and 212 are rigidly connected to outer tube 208 by welds 210 and 214 as shown.

Bolt and nut combination 216/218 securely and rigidly mount plate 206 to housing 12 by passing through apertures in plate 206, housing 12 and plate 200. This arrangement provides a strong and rigid connection for pivot 32. Silicon flat gaskets 219 are placed between plate 206 and housing 12.

Bolts 220 extend through apertures in the vertical arm of fork 30. A small spacer 224 spaces a washer 226 away from the outer surface of fork 30. Nut 228 tightens washer 226 against spacer 224. As can be seen in FIG. 18, plate 212 fits between washers 226 and fork arm 30. When nuts 228 are loosened, it would allow rotation of plate 212 relative to fork 30. Inner tube 202 would rotate with housing 12 and plate 212 in an aperture 230 in the side of fork arm 30. Nuts 228 could be tightened down so that washers 226 clamp plate 212 to fix pivoted orientation of housing 12 to a desired orientation.

C. Operation

Figure 20:
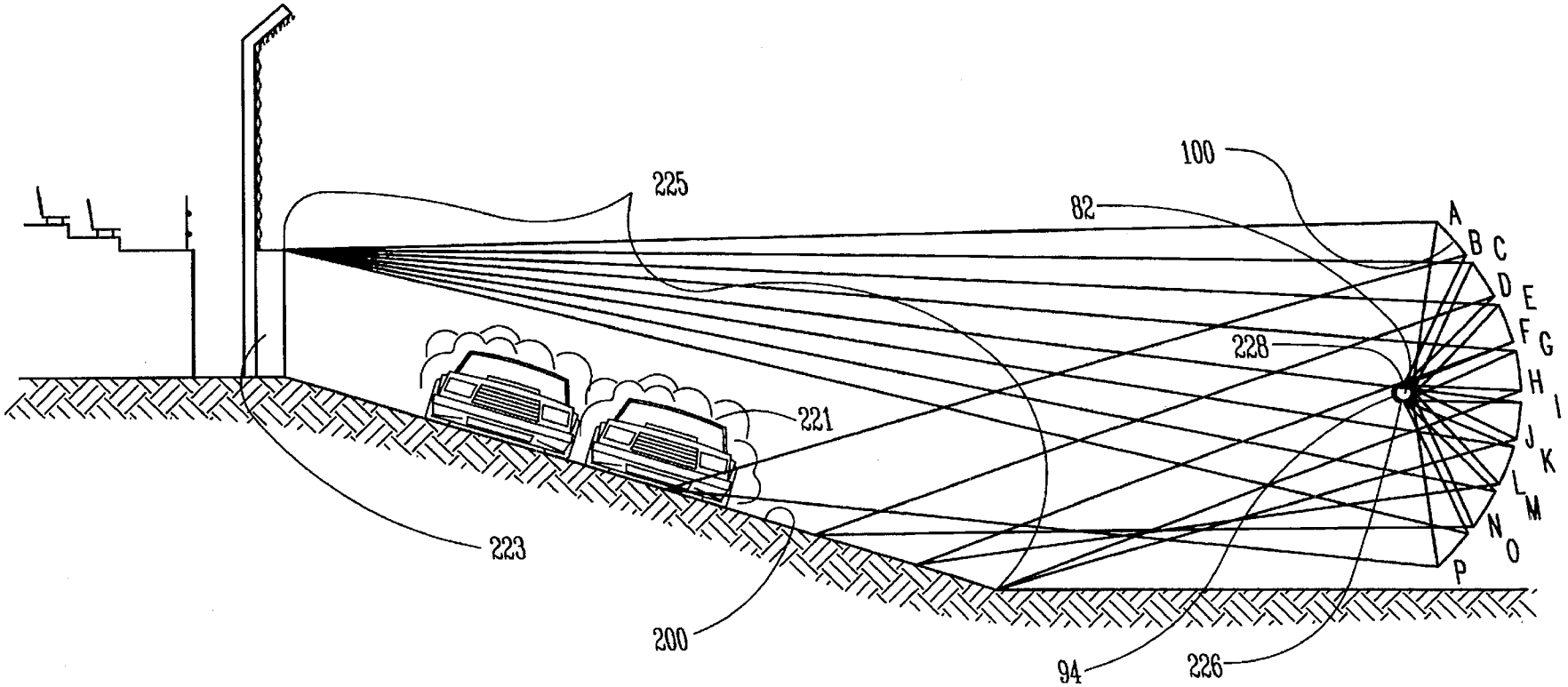
FIG. 20 is a diagrammatic side elevational view illustrating the creation of a defined cutoff for the beam from a fixture according to the preferred embodiment.

FIG. 20 shows diagrammatically and not to scale, a race track 200. As with U.S. Pat. Nos. 5,337,221 and 5,343,374, this could be a track of over a mile in length and of substantial width. To assist in understanding how fixtures 10 can be utilized in operation, they are shown spaced apart on the ground around the infield of track 200. As is discussed in U.S. Pat. Nos. 5,337,221 and 5,343,374, the advantages of such an arrangement include the ability to eliminate tall poles in the infield which blocks the views of spectators in the infield of the track, blocks the views of the spectators outside the track of portions of the track on the far side of the track from them, and which creates "picket fence" problems with cars traveling at high speed not only for spectators but also for television coverage. Additionally, by placing fixtures 10 on the ground the light sources are near where the light needs to be, namely on the track, and the high control of controllability of fixtures 10 of light, allows placement of light on the track and abrupt cutoff so that light does not spill into spectators eyes, even in locations near the outer edge of the track.

It is to be understood, however, that fixtures 10 could also be placed on poles, including very tall poles. They could also be placed on elevated structures such as press boxes, beams, super-structure, etc. In many cases, use of fixtures 10 would allow a reduction of the number of fixtures of conventional types needed. Thus, less energy, less cost, and less maintenance generally follows.

FIG. 20 depict the type of beam pattern that can be generated from fixtures 10. A very controlled pattern with sharp cutoffs is highly advantageous for the previously described reasons with regard to the race track.

Additionally, the preferred embodiment, with light source mount 58, blocks from direct view the light source 80 to eliminate glare into spectators eyes and to eliminate glare for drivers.

Fixtures 10 are placed at spaced apart positions and are adjusted on the trunnion mounts to project the beams for optimum utilization on track 200. It is to be understood that components such as lock nuts and set screws, or other methods can be used to allow adjustment of fixtures 10 and then lock them in place.

In practice, each segment 100 or 100A is individually adjusted to insure the sharp cutoff line as to the spectators outside the track. It is to be understood that in the arrangement shown for fixture 10, the bottom of arc tube 82 always defines the top of the beam projected by fixture 10. Thus, by trial and error by individual adjustment of each segment for each fixture 10, the cutoff line for each segment can be made to be the top of any retaining wall around the track, for example, to insure the sharp cutoff. Usually, there is not more than 5° or so adjustment for each segment, but this could vary and include larger adjustment angles.

The adjustability of each segment also allows for factory aiming of the segments. In other words, for a given lighting application, segments could be pre-aimed off site to produce a beam of certain characteristics so that they could be simply shipped to site and aligned according to the predetermined design. This would eliminate on site manipulation of the mirror segments.

Another aspect of the invention is the ability to adjust the secondary reflector inside the fixture. In other words, it can be rotated relative to the housing of the fixture and actually tilted. This would be in addition to rotation and tilting of the fixture housing. An example of when this would be needed would be in the race track setting. If the fixture as a whole is rotated to project most of the beam up the track to avoid it shining into the drivers eyes as they pass, the top precise cutoff of the fixture may not match precisely with the restraining wall on the other side of the track. By enabling the secondary mirror inside the fixture to be tilted relative to the fixture and relative to the ground, the cutoff along the restraining wall could be brought back into a match with the top of the restraining wall.

An increase in efficiency over the embodiments of U.S. Pat. Nos. 5,337,221 and 5,343,374 is a result of a number of factors. Efficiency as used above, relates primarily to how well the available light was utilized. For example, by fitting segments 100 or 100A along the parabola, and designing their size and shape with reference to the size and shape of the light source, light from the light source can be better fit to the target. In other words, if the light from the fixture fits in the target, it is not wasting light outside the target and therefore is more efficient.

It is noted that utilization of curved mirror segments 100A further helps this efficiency because of the ability to provide a very narrow vertical beam from each segment. In the example of a race track, the need for a very precise cutoff at the top of the outer wall, to prevent light from going to the spectators and to fit all light on the long and narrow track running laterally in front of the lights, allows use of the precise narrow 10° beams. Lighting according to the preferred embodiment can realize on the order of a three times more efficiency than the embodiment shown in U.S. Pat. Nos. 5,337,221 and 5,343,374.

A second example of why efficiency is increased is the utilization of primary reflector 94. Reflector 94 essentially gathers more light. Without it secondary reflector 70 would gather approximately 180° of light from the arc. With reflector 94 on the order of 120° more light from the light source is gathered. Some of that light would otherwise bounce to the sides of the fixture or outside the target area, or would be too wide to use for the target area.

Another example of an increase in efficiency is utilization of side mirrors 72 and 74 (see FIG. 2 and 13). These can actually be termed as third reflectors because they are gathering light not taken directly from the light source, but light that is reflecting off of the secondary reflector and which otherwise would be unusable or absorbed by the sides of the interior of the fixture, instead directing it back to the target.

A still further example of the ability to increase efficiency is to utilize a non-reflective coating on both surfaces of lens 24 on the front of the fixture. This reduces the reflective loss that occurs when light hits the first and second surfaces of glass.

Therefore, the total design of the present invention results in substantial increases of efficiency over fixtures disclosed in U.S. Pat. Nos. 5,337,221 and 5,343,374, and even further efficiency over standard lighting fixtures.

FIGS. 2 and 13 illustrate additional efficiency can be made possible by utilizing side mirrors 72 and 74 (normally they are both on interior sides of fixture 10). FIG. 13 shows that mirrors 72 and 74 can be hingeably adjusted (see rod 73 that extends between upper and lower brackets 125 and 123 on each side of frame 110) to take light and put it back to the target. It is to be understood that segments 72 and 74 can be used to narrow the width of the beam from fixture 10 if desired. It is to be understood that the efficiency of these fixtures is accomplished by fitting the beam to the shape of the target. There is not additional light created to any great degree. For example, in comparison with the fixtures in U.S. Pat. Nos. 5,337,221 and 5,343,374, in certain situations light from the light source of primary reflector falls outside the secondary reflector and therefore would be lost because it would not be transmitted back to the target.

The "efficiency" discussed with regard to these fixtures in certain situations would allow the substantial spacing between the fixtures. For example, compared to the lighting system in U.S. Pat. Nos. 5,337,221 and 5,343,374, fixtures 10 could be spaced at farther apart distances along a race track. One reason you would want to space the fixture further apart is to avoid having too much light built up on the track. The spacing between fixtures is driven primarily by how much light is produced for a certain wattage of lamps. To help understand this concept, fixtures 10 could be spaced closer together and smaller wattage light sources could be utilized It is to be understood that it is sometimes desirable to block off some of the light to eliminate glare. For example, light source mount 58 can have its exterior painted flat black. Mount 58 not only blocks light directly from arc tube 82 out of the fixture, but by painting it flat black it can absorb light that might otherwise cause glare or other problems.

D. Options, Features, and Alternatives

The included preferred embodiment is given by way of example only and not by way of limitations to the invention, which is solely described by the claims. Variations obvious to one skilled in the art will be included within the invention defined by the claims. It will be appreciated that the present invention can take many forms and embodiments. Some alternatives have been mentioned previously. Additional examples are as follows.

It is possible to use first surface or second surface reflectors or mirrors with regard to reflector 94. A first surface mirror would be used in many instances because it would help better cutoff of the light. Small distances at or near the arc of the arc tube can translate into big differences out at the track.

The lens 24 at the front of fixture 10 can be glass. One option is to use an anti-reflection coating on both surfaces of front glass panel 24 to reduce the reflection of each surface of the glass lens and to reduce glare caused by such reflection. The utilization of segments 100 or 100A can in some situations, if used alone, cause striation problems. For example, in the U.S. Pat. Nos. 5,337,221 and 5,343,374, the segmented type mirrors, each individually aimable, may have areas of decreased intensity followed by increased intensity, etc. The fixture of fixture 10 of the present invention deals with this problem by utilizing reflector 94 close to arc tube 82. It redirects light back through the arc stream and cooperates with the light directly leaving the arc tube and traveling to reflector 70 to smoothly fill in between beams from segments 100 and 100A.

It is also to be understood that since individual segments 100 and 100A are used, they can be switched or they could be adjusted to customize the beam. An example is as follows. By tilting the mirror segments around their horizontal axis the beam can be stretched vertically. But there is a limit, however, as to how far this could be stretched. If mirror segments (either flat segments 100 as shown in FIG. 14A or curved segments 100A as shown in FIG. 14B) are tilted to widen the beam too far, it might create a non-smooth beam pattern at the target area with striations (areas of more light intensity and areas of less light intensity in an alternating fashion). In the case of the curved mirror segments 100A of FIG. 14B, it is to be understood that the parabola of line 106 curves more substantially near the vertex of the parabola. Therefore, segments 100A near the vertex have a larger curvature than those at the outer ends of mirror 70 to enable the inner segments 100A to closely follow the curvature of line 106. It has been discovered that beam width could be widened simply by switching the higher curvature inner segments 100A with lower curvature outer segments 100A. Thus, the structure described above regarding the mounting of segments 100A allows relatively easy removal and switching of segments to accomplish this function.

It is also to be understood that each of the mirror segments can be pre-aimed. This means that it is possible to overlay the reflection from one segment onto the reflection of another to double the intensity out at the track for that area of the beam. It is also to be understood that the use of a trunnion or similar mounting system allows for precise aiming of the beam for different part of the track and of the adjustment of the beam. The individual adjustability of the mirror segments allows the matching of cutoff points for each reflected image, as previously explained.

The precise way in which segments 100 or 100A are mounted to the reflector frame can also vary. In the present embodiment, a special mounting system is used to assist in aiming of the individual segments.

It is also to be understood that ballasts for the arc tubes can be placed inside of housing 12 or outside of the box to eliminate thermal problems.

It is to be understood that the preferred embodiment utilizes rectangular shaped mirror segments on the secondary reflector, and a somewhat elongated or linear light source that is elongated in the direction of the elongation of the mirror segments. This arrangement fits the light to the target area in the context of a race track because the race track and retaining wall which need to be lighted are elongated horizontally but require a very narrow vertical beam spread to place light on the relatively narrow horizontal strip and retaining wall defined by the track without placing light above the retaining wall into the spectators, or placing a lot of light on the infield side of the track. The preferred embodiment would therefore be applicable to such things as square rectangular target areas like basketball courts, hockey playing areas, football fields, rectangular stages, and the like.

To assist in understanding how precise cutoff at the top of the beam can be achieved, reference can be taken to FIG. 20. This view is diagrammatic, not to scale, and for illustration purposes only. It depicts a light source 82 and primary reflector 94 and several representative mirror segments 100 for a secondary reflector 70. A race track 200 with retaining wall 223 and race cars 221 are depicted.

Numeral 226 represents generally the bottom of arc tube 94 and numeral 228 represents the top. Letters A, C, E, G, I, K, M, and O represent the top edge of each segment 100 whereas B, D, F, H, J, L, N, and P represent the bottom edges.

The basic law of angle of incidence equals angle of reflection means that the lowest point on arc tube 82 which projects light to the top edge of any segment 100 will define the top vertical portion of the reflected beam from that particular mirror segment 100. Therefore, the present invention allows placement of segments 100 relative to light source 82 in such a fashion that they can be precisely adjusted so that the angles of reflection can be matched relative the top edges of segments 100 so they all basically converge at the top of retaining wall 223. Therefore, none of the light from any of the segments 100 goes above the top of the wall, producing a very sharp cutoff. The remainder of the light goes across the track (see generally reference numeral 225 which corresponds generally with the beam in this elevational view). It is to be understood that because the segments closest to light source create wider vertical beams than those segments farther away. The closest segments are designed to have vertical beam spreads that cover most of or all the track. As illustrated in FIG. 20, the segments farther from the light source towards the ends of reflector 70 have narrower beam spreads.

Therefore, because each segment 100 is adjusted to have the top of its beam converge to the top of the wall. There is a cumulative overlaying of portions of beams from segments towards the farthest side of track 200. This helps to have a uniform smooth lighting throughout track 200 because more intensity is sent a farther distance away from the fixture whereas less intensity is sent a shorter distance away. Basic laws of lighting thus are used to create uniformity, and this is possible by the individual segments.

FIG. 20 also illustrates that the use of primary reflector 94 gathers more light from light source to be then controlled by segments 100 to put more light in track 200.

I claim:

1. A lighting fixture for lighting a target area of a certain shape and substantial size with a substantial amount of light intensity comprising:

a fixture housing having a substantially transparent front lens;

a high intensity light source positioned in the housing, the light source having a length;

a primary reflector positioned generally along the length of the light source at or near the light source, on the same order of size as the light source, and gathering light from one side of the light source;

a secondary reflector positioned in the housing, of substantially larger size than the primary reflector, spaced from the light source, and extending around an opposite side of the light source from the primary reflector, the secondary reflector including a frame, a plurality of reflector segments of similar size and shape, mounts which position each segment adjacent one another along the frame to form a generally continuous secondary reflector surface, and adjustment components connected between the mounts and the frame allowing adjustable tilting of the segments;

the primary reflector directing its gathered light to the secondary reflector; and the secondary reflector producing a highly controlled composite light beam made up of reflections of light from each of the segments, the reflections being adjustably positioned relative to one another by tilting of the segments, the beam emanating through the lens of the housing.

2. The fixture of claim 1 further comprising second mounts which mount the frame to the housing and adjustment components connected between the second mounts and the frame allowing tilting of the frame in the housing.

3. The fixture of claim 1 the light source is elongated along its length and the segments of the secondary reflector are elongated and rectangular.

4. The fixture of claim 2 wherein the lens has a non-reflective coating.

5. The fixture of claim 1 wherein the secondary reflector is generally flat but curved in one dimension.

6. The fixture of claim 5 wherein the secondary reflector is made out of individual highly specular segments.

7. The fixture of claim 6 wherein the segments are flat.

8. The fixture of claim 6 wherein the segments are curved in the same dimension as the secondary reflector.

9. The fixture of claim 5 wherein the curve is in the shape of a parabola.

10. The fixture of claim 1 when the light source is a high intensity.

11. The fixture of claim 10 wherein the light source is an arc tube.

12. The fixture of claim 11 wherein the arc tube is elongated in length.

13. The fixture of claim 12 wherein the arc tube is positioned laterally in the housing.

14. The fixture of claim 12 wherein the arc tube is positioned at or near the focal point of the secondary reflector.

15. The fixture of claim 11 wherein the primary reflector is mounted close to or on the light source.

16. The fixture of claim 15 wherein the primary reflector is generally flat.

17. The fixture of claim 15 wherein the primary reflector is curved.

18. The fixture of claim 15 wherein the primary reflector is a first surface reflector.

19. The fixture of claim 15 wherein the primary reflector is a second surface reflector.

20. The fixture of claim 11 wherein the primary reflector is a coating on the arc tube.

21. The fixture of claim 20 wherein the primary reflector is curved to the shape of the arc tube.

22. The fixture of claim 1 wherein the primary reflector is highly specular.

23. The fixture of claim 1 wherein the primary reflector reflects a substantial majority of visible light but passes infrared radiation.

24. The fixture of claim 6 further comprising reflecting panels positioned on the interior side walls of the housing.

25. The fixture of claim 24 wherein the reflecting panels are adjustable with respect to the side walls.

26. The fixture of claim 1 further wherein the secondary mounts have releasable components to remove each segment from the frame.

27. The fixture of claim 1 further comprising a mount to which the light source is mounted including a block between the primary reflector and the front of the housing.

28. The fixture of claim 1 further comprising a base upon which the housing is mounted, the base including a pivotable connection to the housing for adjustment of a housing around a first pivot axis and the pivot member for adjustment of the first pivotable connection around a second pivotable axis.

29. A system for lighting a substantial area comprising:

a plurality of fixtures each supported by a base placed at a spaced apart position relative to the area to be lighted;

each fixture comprising:

a housing with an opening covered by a lens;

a high intensity light source in the housing;

a primary reflector positioned close to or on the light source;

a secondary reflector positioned in the housing spaced from the light source;

the primary reflector directing light from the light source to the secondary reflector;

the secondary reflector directing light from the primary reflector and from light source out of the lens; and each fixture having at least two degrees of freedom of movement relative to the base.

30. The system of claim 29 wherein the base is placed on the ground.

31. The fixture of claim 29 wherein the base is placed on a structure which elevates at least some fixtures above the ground.

32. The system of claim 29 wherein the housing comprises an enclosure including the lens over the front of the enclosure.

33. The system of claim 29 wherein the housing is less than four feet by four feet by four feet in dimension.

34. The system of claim 29 wherein the light source comprises an arc tube.

35. The system of claim 29 wherein the light source extends towards opposite side walls of the housing generally in a horizontal plane and parallel to the front lens.

36. A method of lighting a target area having a particular shape comprising:

positioning a light source a distance from the target area;

gathering, very near the light source, direct light from the light source that otherwise would travel in the general direction of the target area;

gathering other light from the light source that would otherwise travel in directions away from the light source;

directing gathered light to generally fit into the particular shape of the target area; and further comprising utilizing a plurality of reflector segments to direct the gathered light, and adjusting each segment relative to the light source so that at least one perimeter side of the gathered light which is directed from the segments is aimed to the same location at the target area to create a sharp, defined cutoff of light at that location.

37. The method of claim 36 wherein the light source is elongated, the segments are elongated and rectangular, and the target area is rectangular.

38. The method of claim 37 wherein the bottom of the light source and a top edge of each segment are parallel.

39. A method of lighting a target area of substantial space and at a substantial distance from a source of light comprising:

reflecting a portion of light generated from an arc tube at a position close to the arc tube with a reflector on the order of size of the arc tube;

redirecting the reflected light and other light from the arc tube in a defined controlled beam to a portion of the target area; and aiming a plurality of defined controlled beams, each produced according to the previous steps, to positions to light all desired portions of the target area.

40. The method of claim 39 wherein the target area is a race track.

41. The method of claim 39 wherein the segments are placed along a parabola having a focal line emanating to the target area, the segments each having a shape which is similar to the shape of the light source and the segments projecting a light beam having a shape that is similar to the shape of the area being lighted.

42. The method of claim 41 wherein each of the segments are rectangular, the light source has a bottom edge that is parallel with top edges of the segments and a sharp, defined cut-off is created by angling each segment so that the top of any beam created by each segment converges to a similar location at the target space, which location defines a boundary of the target space.

43. The method of claim 41 wherein each of the segments is curved in the vertical plane to simulate the curve of the parabola at the location of the segment along the parabola, so that segments nearer the vertex of the parabola are curved more than segments farther away from the vertex.

44. The method of claim 43 further comprising switching at least two segments from different distances relative to the vertex to change composite beam width of the segments.

45. A system for lighting a substantial area comprising:

a plurality of fixtures each supported by a base placed at a spaced apart position relative to the area to be lighted;

each fixture comprising:

a housing with an opening covered by a lens;

a high intensity light source in the housing;

a primary reflector positioned close to or on the light source;

a secondary reflector positioned in the housing spaced from the light source;

the primary reflector directing light from the light source to the secondary reflector;

the secondary reflector directing light from the primary reflector and from light source out of the lens; and the primary reflector is on the same order of size as the light source.

46. A system for lighting a substantial area comprising:

a plurality of fixtures each supported by a base placed at a spaced apart position relative to the area to be lighted;

each fixture comprising:

a housing with an opening covered by a lens;

a high intensity light source in the housing;

a primary reflector positioned close to or on the light source;

a secondary reflector positioned in the housing spaced from the light source;

the primary reflector directing light from the light source to the secondary reflector;

the secondary reflector directing light from the primary reflector and from light source out of the lens; and the secondary reflector in vertical cross-section follows a parabolic shape and has a width that extends towards opposite sides of the housing.

47. A system for lighting a substantial area comprising:

a plurality of fixtures each supported by a base placed at a spaced apart position relative to the area to be lighted;

each fixture comprising:

a housing with an opening covered by a lens;

a high intensity light source in the housing;

a primary reflector positioned close to or on the light source;

a secondary reflector positioned in the housing spaced from the light source;

the primary reflector directing light from the light source to the secondary reflector;

the secondary reflector directing light from the primary reflector and from light source out of the lens; and the secondary reflector comprises individually adjustable segments along a parabolic curve.

* * * * *